US012624511B2

(12) United States Patent
Eerola et al.

(10) Patent No.: US 12,624,511 B2
(45) Date of Patent: May 12, 2026

(54) PILE DRIVING SYSTEM

(71) Applicant: MOVAX OY, Hämeenlinna (FI)

(72) Inventors: Janne Eerola, Hämeenlinna (FI); Mikko Lindeman, Hämeenlinna (FI)

(73) Assignee: MOVAX OY, Hämeenlinna (FI)

( * ) Notice: Subject to any disclaimer, the term of this patent is extended or adjusted under 35 U.S.C. 154(b) by 264 days.

(21) Appl. No.: 18/491,203

(22) Filed: Oct. 20, 2023

(65) Prior Publication Data

US 2024/0133145 A1 Apr. 25, 2024
US 2024/0229402 A9 Jul. 11, 2024

(30) Foreign Application Priority Data

Oct. 20, 2022 (EP) ..... 22202697

(51) Int. Cl.
*E02D 13/00* (2006.01)
*E02D 7/18* (2006.01)

(52) U.S. Cl.
CPC ..... *E02D 13/00* (2013.01); *E02D 7/18* (2013.01)

(58) Field of Classification Search
CPC ..... E02D 13/00; E02D 7/18
See application file for complete search history.

(56) References Cited

U.S. PATENT DOCUMENTS 10,294,624 B2 * 5/2019 Audet ..... E02D 7/18
2008/0310923 A1 * 12/2008 Jinnings ..... E02D 11/00 405/232
2015/0275460 A1 * 10/2015 Audet ..... E02D 7/18 173/38
2018/0195248 A1 * 7/2018 Ozkan ..... E02D 9/02

FOREIGN PATENT DOCUMENTS

CA 2886192 A1 9/2015
EP 2003252 A1 12/2008
EP 3221521 A1 9/2017
EP 2419569 B1 6/2021
EP 4026951 A1 7/2022

OTHER PUBLICATIONS

European Search Report issued in corresponding EP application No. 22202697, mailed May 3, 2023, 2 pages.

* cited by examiner

*Primary Examiner* — Kyle Armstrong
(74) *Attorney, Agent, or Firm* — Meunier Carlin & Curfman LLC

(57) ABSTRACT

The invention relates to a pile driver for driving piles into ground. The pile driver comprises a body, a vibrator unit, a primary first arm and a primary second arm, both being pivotable about a primary axis; and a secondary first arm and a secondary second arm, both being pivotable about a secondary axis, which is parallel with the primary axis. The pile driver comprises an actuator or actuator arrangement for pivoting the arms. A first part of the primary first arm is provided with a primary first attachment for attaching an adapter of an adapter arrangement. An adapter for use with the pile driver. An arrangement comprising the pile driver and two adapter arrangements each comprising at least an adapter.

26 Claims, 10 Drawing Sheets

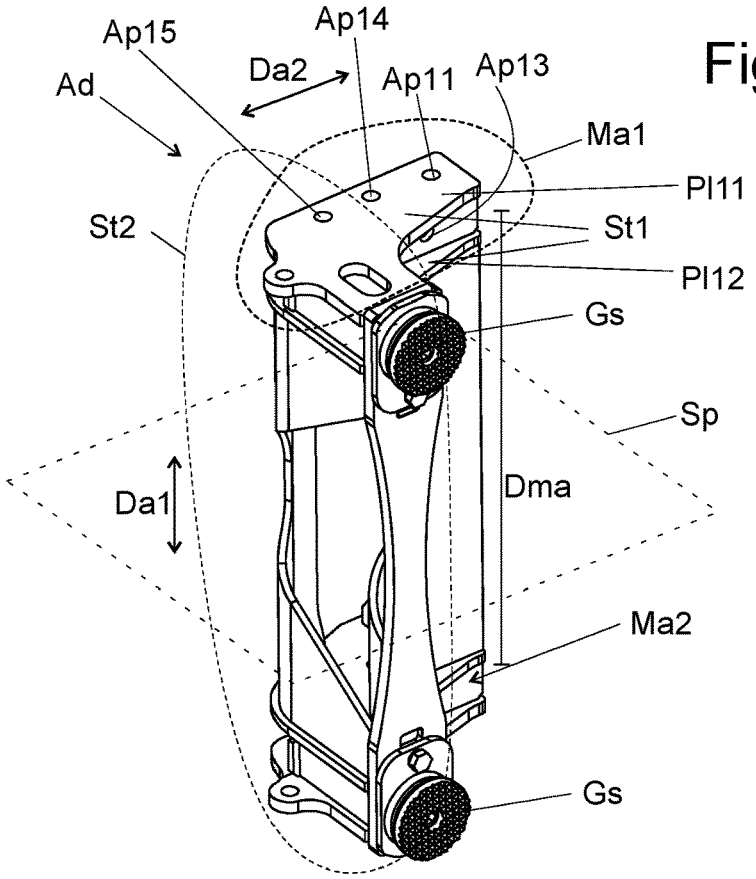
Fig. 3a
Fig. 3b
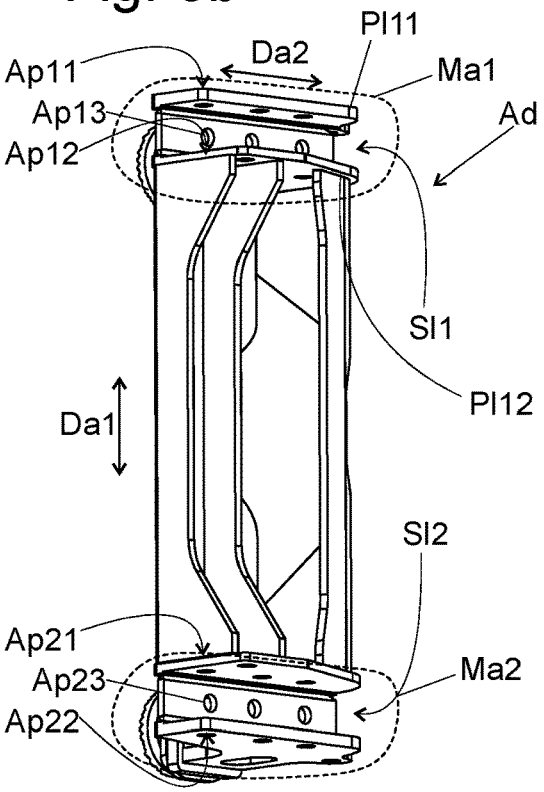
Fig. 3c
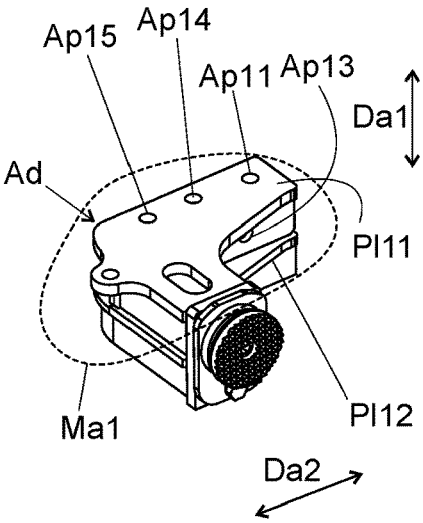

PILE DRIVING SYSTEM

TECHNICAL FIELD

The present disclosure relates to pile driving equipment. More particularly, the present disclosure relates to a vibratory side grip pile driver system.

BACKGROUND

Vibratory pile drivers are used in a plurality of applications to drive piles, such as sheet piles, pipes, I-beams, H-beams, tubes, and poles, into the ground. The pile driver may be mounted on an excavator for using the pile driver. The pile driver includes an articulating arm and side-gripping jaws to facilitate the pile driving process.

Side grip vibratory pile drivers that are designed for driving only one type of piles, such as sheet piles, are known at least from the documents EP 2 419 569 and EP 2 003 252. Moreover, in such side grip vibratory pile drivers, the whole jaws, including the arms of the jaws, may be replaceable. Thus, the whole jaws may be changed corresponding to the shape of the object to be driven to ground. However, changing the jaws is a reasonably complex task. Moreover, it is known to use different kind of gripping profiles adapted for gripping a variety of different pile profiles. Such gripping profiles may be attached to a jaw of the pile driver system. However, in such systems the variety of the different objects to be driven is limited by the shape of the arms of the jaws, because such of gripping profiles are arranged on the arms of the jaws.

SUMMARY

It has been found that the variety of objects to be driven can be increased by gripping the object with adapters that are fixed to arms of the jaws of the pile driver. More specifically, the adapters themselves form an extension to the arms of the jaws. Thus, the arms themselves can be short. Therefore, the shape of the arms of the jaws do not limit the variety of the objects to be gripped. In an embodiment, this is achieved by having a pile driver that only has short arms, and the adapters then form extensions to the arms. Thus the shape of the adapter having arm extension can be designed according to needs. Moreover, the short arms as such make it easier to change the arms, if needed e.g. for maintenance.

In an embodiment of an adapter as such, the adapter comprises a slot or slots configured to receive one or two arms of the pile driver. In an embodiment of the pile driver as such, the attachments of the arms of the pile driver are configured to be attached to such adapters. An embodiment of an arrangement comprises a pile driver and a pair of adapter arrangements; each adapter arrangement comprising one or two adapters.

An embodiment of a pile driver comprises arms, e.g. short arms, provided with attachments for attaching the adapter of the adapter arrangements. An embodiment of an adapter comprises a mounts for fixing to an arm of the pile driver. An embodiment of an adapter comprises two mounts, each one for fixing to an arm of the pile driver. Moreover, the adapter comprises a stiffening member or stiffening members so that is may function as an extension of the jaw arms of the pile driver. It may also synchronize the pivoting of two arms.

The invention is disclosed in more specific terms in the independent claims. Preferable embodiments are disclosed in dependent claims. These and other embodiments are disclosed in the description and the drawings.

BRIEF DESCRIPTION OF THE DRAWINGS

FIG. 3*a* shows a perspective view of an adapter, FIG. 3*b* shows another perspective view of the adapter of FIG. 3*a*, FIG. 3*c* shows a perspective view of an adapter.

DETAILED DESCRIPTION

Figure 1A:
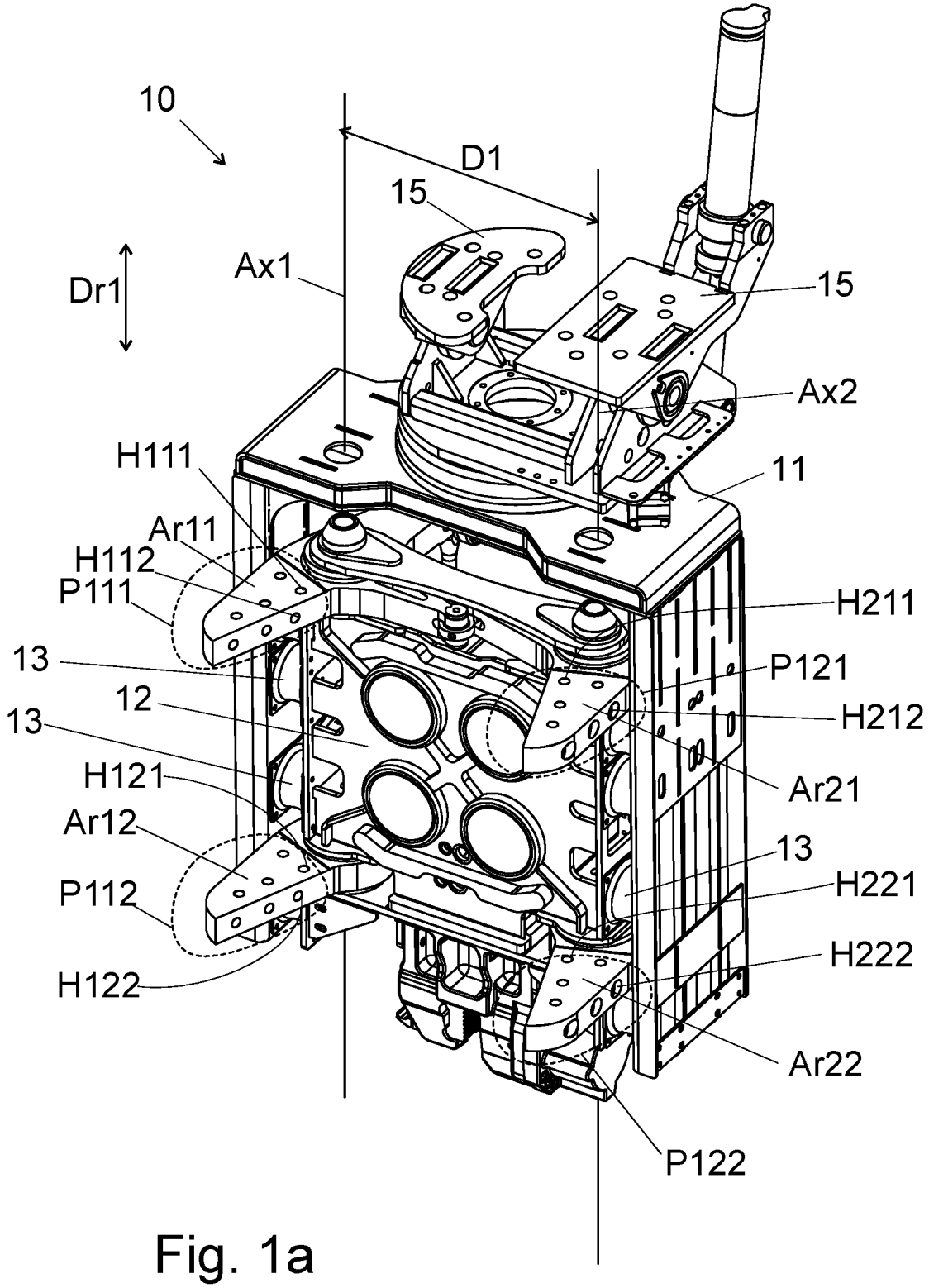
FIG. 1*a* shows a perspective view of a pile driver and some measures thereof.
Figure 1B:
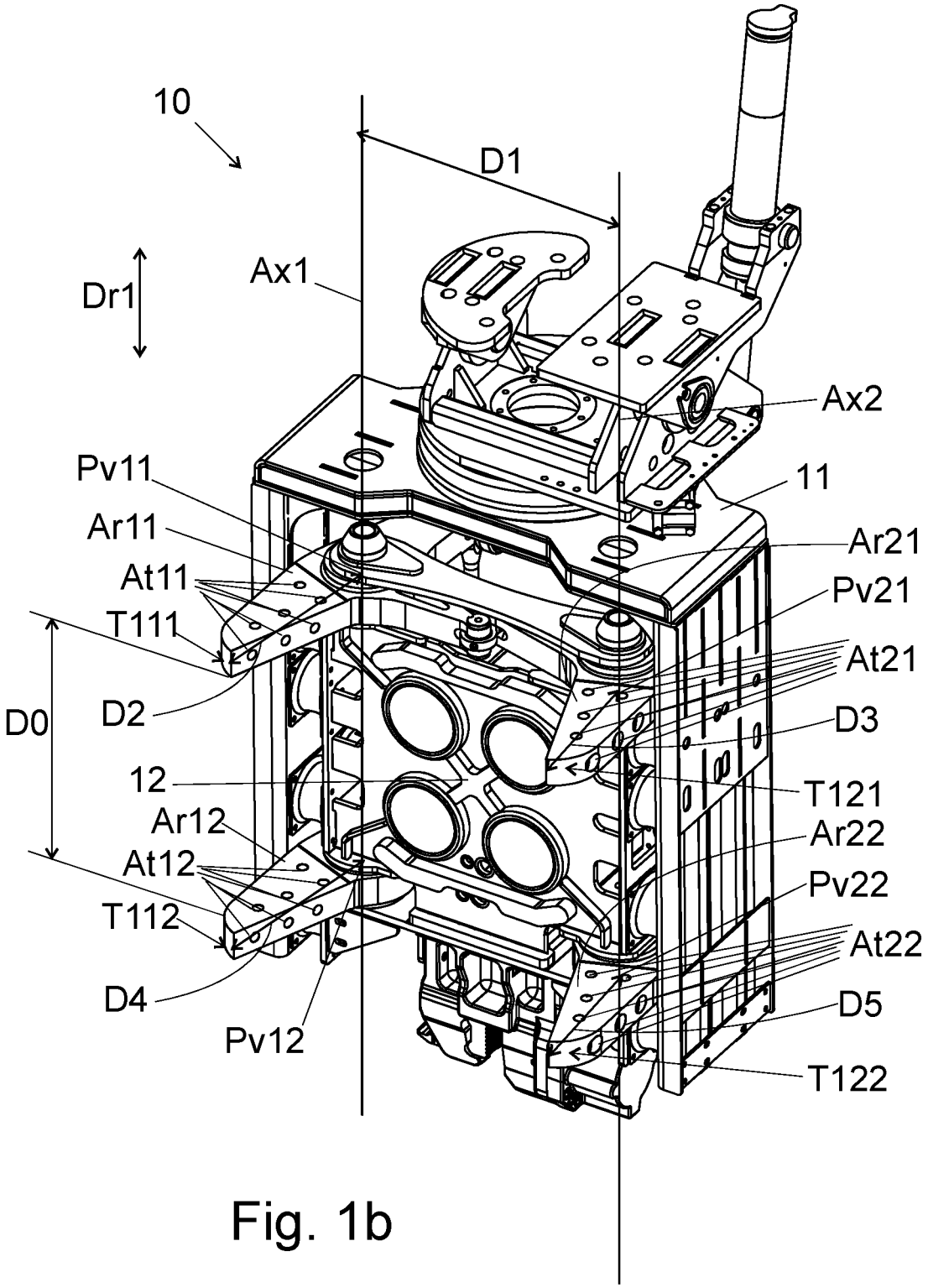
FIG. 1*b* shows the perspective view of the pile driver of FIG. 1*a* and some further measures thereof.

FIGS. 1*a* and 1*b* show, in a perspective view of, a pile driver 10. The pile driver 10 comprises arms (Ar11, Ar12, Ar21, Ar22). The pile driver 10 is configured to be used with adapters Ad10, Ad20, Ad11, Ad12, Ad21, Ad22 (see FIGS. 4*b* and 8) fixable to the arms Ar11, Ar12, Ar21, Ar22 (FIGS. 1*a* and 1*b*) of the pile driver 10. The pile driver 10 and the adapters Ad10, Ad20, Ad11, Ad12, Ad21, Ad22 form an arrangement 20. The arrangement 20 is used to first grip an object from a side (as depicted e.g. in FIG. 1 of EP 2 003 252) and to drive the object to ground.

The object to be driven with the pile driver e.g. to the ground is gripped with the adapters Ad10, Ad20, Ad11, Ad12, Ad21, Ad22. A primary adapter arrangement Aa1 is configured to grip the object from a primary side and a secondary adapter arrangement Aa2 is configured to grip the object from a secondary, opposite side.

Figure 4A:
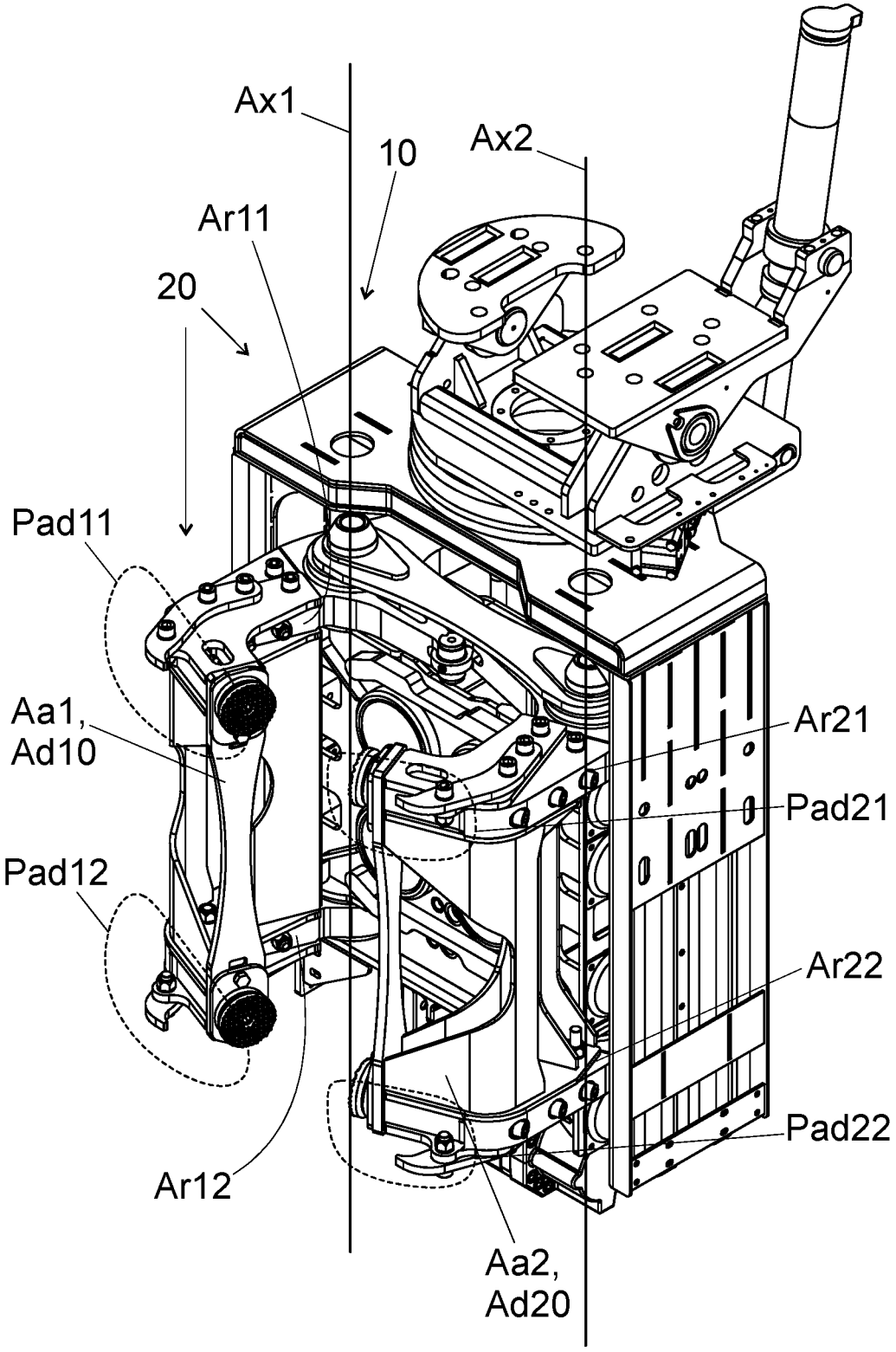
FIG. 4*a* shows a perspective view of an arrangement comprising the pile driver of FIG. 1*a*, and a primary adapter and a secondary adapter fixed to the arms of the pile driver.
Figure 4B:
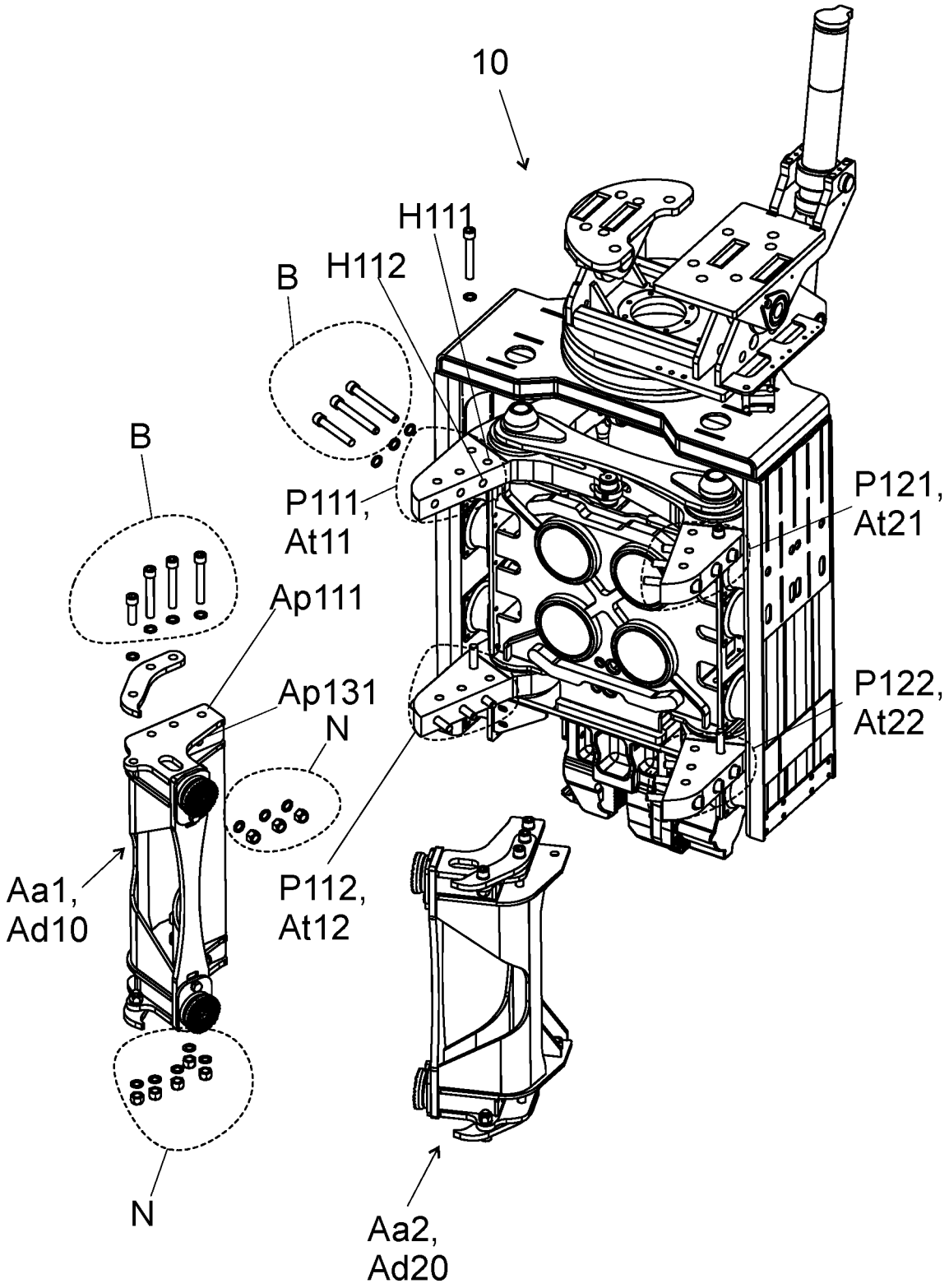
FIG. 4*b* shows a perspective view of an arrangement comprising the pile driver of FIG. 1*a*, and a primary adapter and a secondary adapter dismounted from the arms of the pile driver.
Figure 8:
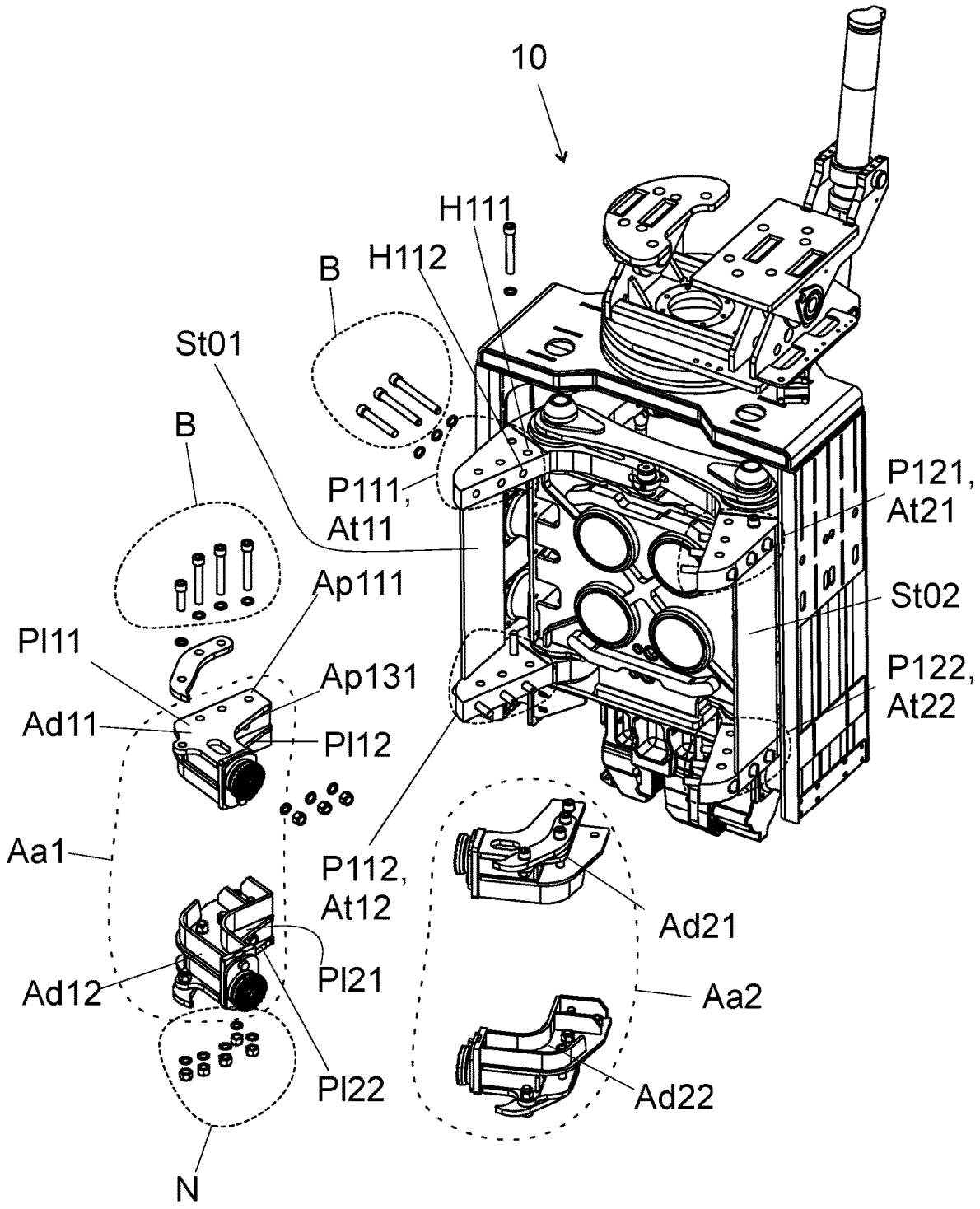
FIG. 8 shows a perspective view of an arrangement comprising a pile driver, a primary adapter arrangement having two adapters, one for each arm on the left side, and a secondary adapter arrangement having two adapters, one for each arm on the right side.

Referring to FIG. 4*b*, in an embodiment, a primary adapter arrangement Aa1 comprises a primary adapter Ad10 fixable to the two arms on the left (hereinbelow primary arms). Referring to FIG. 8, in an embodiment, a primary adapter arrangement Aa1 comprises a primary first adapter Ad11 is fixable to the upper left arm and a primary second adapter Ad12 is fixable to the lower left arm. The primary adapter arrangement Aa1 is attached to both the left arms. In a similar way, a secondary adapter arrangement Aa2 is attached to both the right arms (hereinbelow secondary arms), and the secondary adapter arrangement Aa2 may comprise a secondary adapter Ad2 or both a secondary first adapter Ad21 and a secondary second adapter Ad22.

Thus, in use, the primary adapter arrangement Aa1 is attached to both the primary arms Ar11, Ar12 and the secondary adapter arrangement Aa2 is attached to both the secondary arms Ar21, Ar22 so that a part of the object (e.g. a pile) remains in between the adapter arrangements Aa1, Aa2. For the purpose gripping, each adapter Ad10, Ad11, Ad12, Ad20, Ad21, Ad22 has a gripping surface Gs (see FIG. 3*a*) that contacts the object while gripping. Thus, the pile driver 10 is suitable for driving piles into ground. Thus, the arrangement 20 is suitable for gripping an object (e.g. pile) from the side of the object and for driving the object into ground.

More specifically, referring to FIG. 1*a*, the pile driver 10 comprises a body 11, which is attachable to a power tool, such as an excavator or other suitable construction machine for mounting pile driver 10 thereon. Thus, the body 11 comprises an attachment assembly 15 for attaching the pile driver 10 to the power tool.

The pile driver 10 comprises a vibrator unit 12. The vibrator unit 12 is attached to the body 11. A function of the vibrator unit 12 is to generate vibration, which is guided through the body 11, the arms Ar11, Ar12, Ar21, Ar22, and the adapters Ad10, Ad11, Ad12, Ad20, Ad21, Ad22 to the pile (or object). As the pile (or object) vibrates, it can easily be pushed into the ground with the arrangement 20. The vibrator unit 12 is preferably attached to the body 11 through damping cushions 13. The damping cushions 13 may be attached to the sides of the vibrator unit 12.

Referring to FIG. 1*a*, the pile driver 10 comprises a primary first arm Ar11 and a primary second arm Ar12. The primary first arm Ar11 and the primary second arm Ar12 are pivotable about a primary axis Ax1. The primary axis Ax1 defines a first direction so that that primary axis Ax1 is arranged in the first direction Dr1. As will be detailed below, a primary adapter arrangement Aa1 is fixable to both the primary first arm Ar11 and the primary second arm Ar12. As detailed in the figures the term "direction" within this description refers to both the two possible directions, which are reverse to each other; unless otherwise indicated.

The pile driver 10 comprises a secondary first arm Ar21 and a secondary second arm Ar22. The secondary first arm Ar21 and the secondary second arm Ar22 are pivotable about a secondary axis Ax2. The secondary axis Ax2 is parallel with the primary axis Ax1. As will be detailed below, a secondary adapter arrangement Aa2 is fixable to both the secondary first arm Ar21 and the secondary second arm Ar22.

Figure 2A:
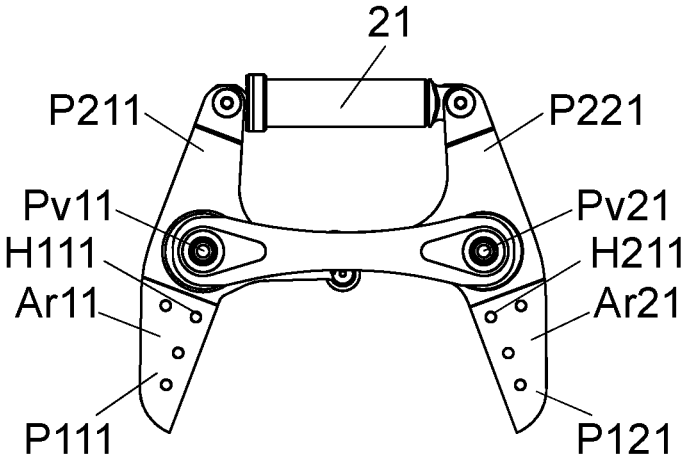
FIG. 2*a* shows a top view of an actuator and arms of a pile driver, the actuator being arranged to open and close the arms.

Referring to FIG. 2*a*, the pile driver comprises an actuator 21 or an actuator arrangement. The purpose of the actuator 21 or the actuator arrangement is to pivot, on one hand, at least one of the primary first arm Ar11 and the primary second arm Ar12 about the primary axis Ax1 and, on the other hand, at least one of the secondary first arm Ar21 and the secondary second arm Ar22 about the secondary axis Ax2.

Figure 2B:
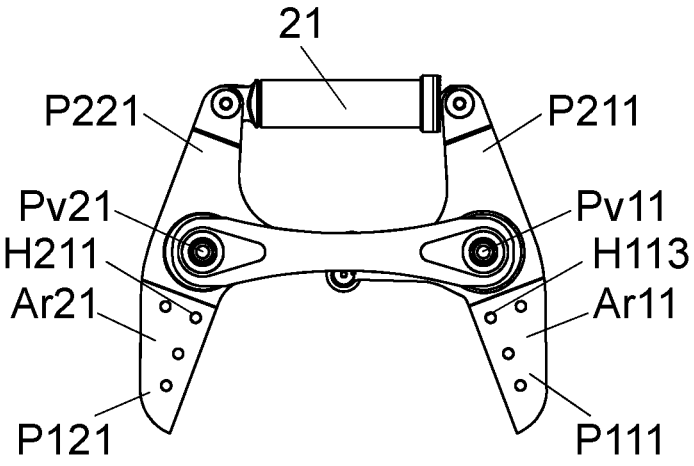
FIG. 2*b* shows a bottom view of the actuator and the arms of FIG. 2*a*.

Referring to FIGS. 1*a* and 1 *b*, a first part P111 of the primary first arm Ar11 is provided with a primary first attachment At11. The primary first attachment At11 is for attaching an adapter (Ad10, Ad11) of the primary adapter arrangement Aa1. As shown in FIGS. 2*a* and 2*b*, in an embodiment, the actuator 21 is fixed to a second part P211 of the primary first arm Ar11. Therein a primary first pivot Pv11, about which the primary first arm Ar11 is configured to pivot, is arranged between the first part P111 of the primary first arm Ar11 and the second part P211 of the primary first arm Ar11.

A first part P121 of the secondary first arm Ar21 is provided with a secondary first attachment At21. The secondary first attachment At21 is for attaching an adapter (Ad20, Ad22) of the secondary adapter arrangement Aa2. As shown in FIGS. 2*a* and 2*b*, in an embodiment, the actuator 21 is fixed to a second part P221 of the secondary first arm Ar21. Therein a secondary first pivot Pv21, about which the secondary first arm Ar21 is configured to pivot, is arranged between the first part P121 of the secondary first arm Ar21 and the second part P221 of the secondary first arm Ar21.

FIGS. 2*a* and 2*b* show the actuator 21, in this case a hydraulic cylinder, for pivoting the primary first arm Ar11 and the secondary first arm Ar21. When the actuator 21 shortens, the arms Ar11, Ar21 open such the attachments At11, At21 thereof (see FIG. 1*b*) move further away from each other, and when the actuator 21 becomes longer, the arms Ar11, Ar21 close.

Moreover, referring to FIGS. 1*a* and 1 *b*, a first part P112 of the primary second arm Ar12 is provided with a primary second attachment At12. The primary second attachment At12 is for attaching an adapter Ad10, Ad12 of the primary adapter arrangement Aa1. A first part P122 of the secondary second arm Ar22 is provided with a secondary second attachment At22. The secondary second attachment At22 is for attaching an adapter Ad20, Ad22 of the secondary adapter arrangement Aa2.

Having pivotable primary arms Ar11, Ar12 and pivotable secondary arms Ar21, Ar22 has also effect on the variety of objects to be handled. Having all the arms pivotable ensures that the jaws of the pile driver 10 open out a reasonable large distance to receive also large objects. This applies particularly, when the arms are reasonably short.

Referring to FIG. 4*b*, in an embodiment, a primary adapter Ad10 of the primary adapter arrangement Aa1 is so stiff, that both the primary first arm Ar11 and the primary second arm Ar12 pivot together, when the primary adapter Ad10 is attached to the primary arms Ar11, Ar12, even if the actuator 21 or the actuator arrangement is configured to pivot only one of the primary arms 11, 12. Thus, in an embodiment the adapter comprises a primary second stiffening member St12 that is configured to stiffen the primary adapter Ad10. In the embodiment, the primary second stiffening member St12 forms a primary stiffener of an arrangement 20, the primary stiffener being configured to couple the primary first arm Ar11 and the primary second arm Ar12 such that the primary first arm Ar11 and the primary second arm Ar12 pivot together.

However, referring to FIG. 8, in an embodiment, the primary adapter arrangement Aa1 comprises a primary first adapter Ad11 and a primary second adapter Ad12 the primary adapter arrangement Aa1 not bonding the arms Ar11 and Ar12 together. Thus, in this embodiment, the pile driver 10 comprises a primary stiffener St01 configured to couple the primary first arm Ar11 and the primary second arm Ar12 such that the primary first arm Ar11 and the primary second arm Ar12 pivot together. Thus, in an embodiment, the primary stiffener St01 is fixed to the primary first arm Ar11 and the primary second arm Ar12.

In a similar way, in an embodiment, a secondary adapter Ad20 of the secondary adapter arrangement Aa2 is so stiff, that both the secondary first arm Ar21 and the secondary second arm Ar22 pivot together, when the secondary adapter Ad20 is attached to the secondary arms Ar21, Ar22, even if the actuator 21 or the actuator arrangement is configured to pivot only one of the secondary arms Ar21, Ar22. An actuator arrangement comprises at least an actuator 21, and it may comprise more actuators. For example, the actuator 21 may pivot the arms Ar11 and Ar21 (see FIGS. 2*a* and 2*b*) and another actuator of the actuator arrangement may pivot the arms Ar12 and Ar22. Thus, in an embodiment the adapter comprises a secondary second stiffening member St22 that is configured to stiffen the secondary adapter Ad20. In the embodiment, the secondary second stiffening member St22 forms a secondary stiffener of an arrangement 20, the secondary stiffener being configured to couple the secondary first arm Ar21 and the secondary second arm Ar22 such that the secondary first arm Ar21 and the secondary second arm Ar22 pivot together.

However, referring to FIG. 8, in an embodiment, the secondary adapter arrangement Aa2 comprises a secondary first adapter Ad21 and a secondary second adapter Ad22 the secondary adapter arrangement Aa2 not bonding the arms Ar21 and Ar22 together. Thus, in this embodiment, the pile driver 10 comprises a secondary stiffener St02 configured to couple the secondary first arm Ar21 and the secondary second arm Ar22 such that the secondary first arm Ar21 and the secondary second arm Ar22 pivot together. Thus, in an embodiment, the secondary stiffener St02 is fixed to the secondary first arm Ar21 and the secondary second arm Ar22.

When the primary first arm Ar11 and the primary second arm Ar12 pivot together (i.e. they operate synchronously together) and the secondary first arm Ar21 and the secondary second arm Ar22 pivot together (i.e. also they operate synchronously together), the pressure caused by the adapter arrangements Aa1, Aa2 to the object to be driven as levelled out well. Thus, it is preferable that the arrangement 20 comprises the primary stiffener and the second stiffener in the above meaning.

However, in the embodiment of FIGS. 1*a*, 1*b*, 4*a*, and 4*b*, the primary first arm Ar11 is pivotable about the primary axis Ax1 independently of the primary second arm Ar12, when no adapter is mounted to the vibrator device 10. This has the benefit that when the arms Ar11 and Ar12 are changeable (as detailed below), the arms can be changed much more easily, because they are not coupled to each other by the primary stiffener St01 of FIG. 8. For similar reason it beneficial that the secondary first arm Ar21 is pivotable about the secondary axis Ax2 independently of the secondary second arm Ar12, as in FIGS. 1*a*, 1*b*, 4*a*, and 4*b* and as opposed to FIG. 8.

However, for levelling the pressure, in such an embodiment, preferably the primary adapter arrangement Aa1 comprises a primary adapter Ad10 that is mountable to both the primary arms Ar11, Ar12 and comprises the primary second stiffening member St12.

As detailed above, the vibration, which generated by the vibrator unit 12, is guided through the body 11, the arms Ar11, Ar12, Ar21, Ar22, and the adapters Ad10, Ad20 to the object (e.g. pile) to be driven. It has been found that the maintenance needs of the pile driver 10 are reduced, when the vibration is guided substantially equally through all the arms. Therefore, in a preferable embodiment, the vibrator unit 12 is arranged between an upper pair of arms and a lower pair of arms.

Figure 7:
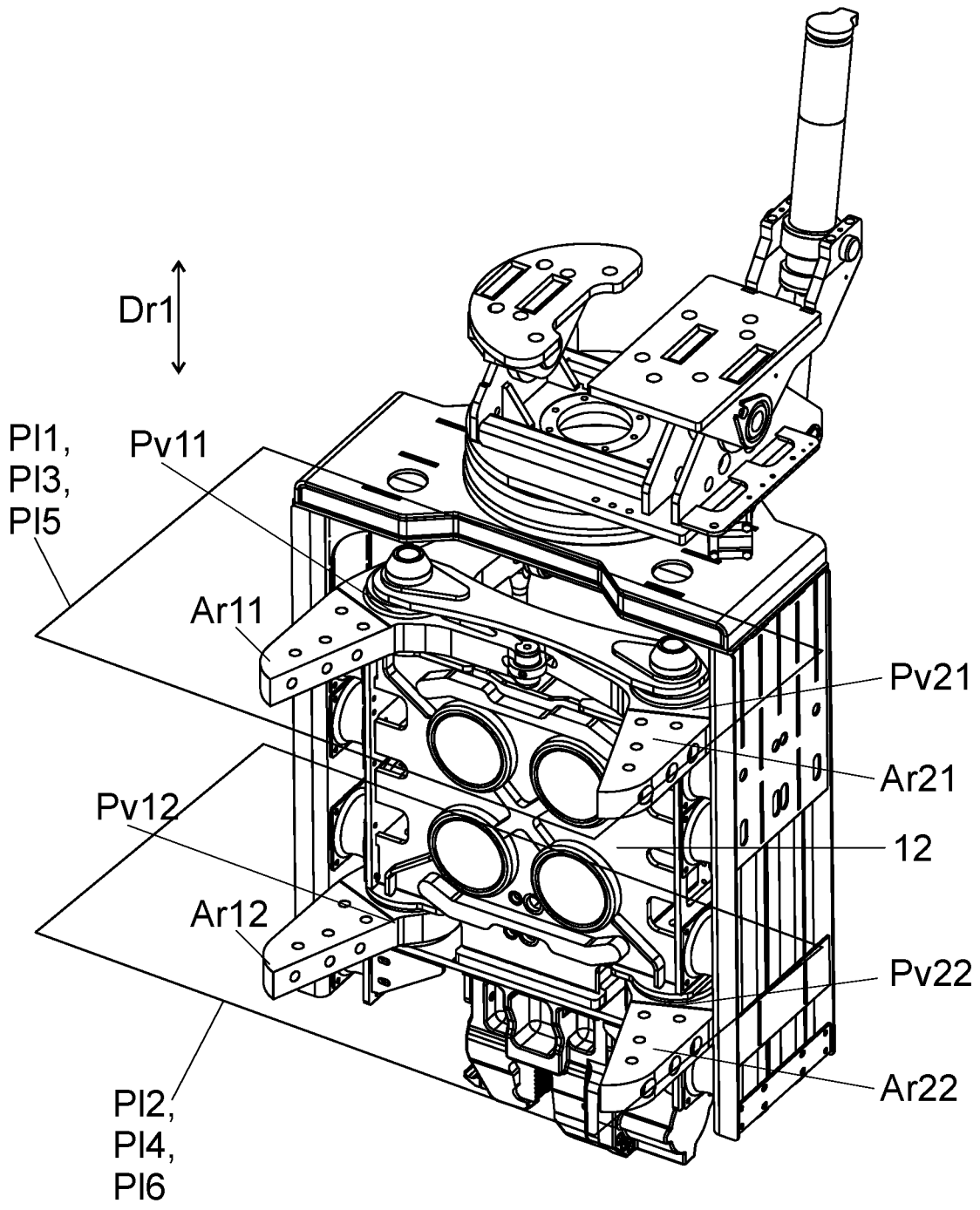
FIG. 7 shows a perspective view of the pile driver of FIG. 1*a* and some planes defined by the structure of the pile driver.

More specifically, in an embodiment, the primary first arm Ar11 is configured to pivot about a primary first pivot Pv11. The primary first pivot Pv11 is arranged on the primary axis Ax1. Moreover, the primary second arm Ar12 is configured to pivot about a primary second pivot Pv12, which is arranged on the primary axis Ax1. Referring to FIG. 7, in an embodiment, the vibrator unit 12 is arranged between a first plane Pl1 and a second plane Pl2. The first direction Dr1 is normal to the first plane Pl1. The first plane Pl1 intersects the primary first pivot Pv11. The first direction Dr1 is normal to the second plane P12. Moreover, the second plane Pl2 intersects the primary second pivot Pv12. Thus, the vibrator unit 12 is arranged, in the first direction Dr1, between the primary first arm Ar11 and the primary second arm Ar12.

In an embodiment, the vibrator unit 12 is arranged, in the first direction Dr1, between the secondary first arm Ar21 and the secondary second arm Ar22. In line with what has been said above, in an embodiment, the secondary first arm Ar21 is configured to pivot about a secondary first pivot Pv21, and the secondary second arm Ar22 is configured to pivot about a secondary second pivot Pv22. Moreover, in an embodiment, the vibrator 12 unit is arranged between a third plane Pl3 and a fourth plane Pl4. As for the third plane Pl3, the first direction Dr1 is normal to the third plane Pl3 and the third plane Pl3 intersects the secondary first pivot Pv21. As for the fourth plane Pl4, the first direction Dr1 is normal to the fourth plane Pl4 and the fourth plane Pl4 intersects the secondary second pivot Pv22.

One plane may serve as both the first plane Pl1 and the third plane Pl3, as in FIG. 7. Another plane may serve as both the second plane Pl2 and the fourth plane Pl4, as in FIG. 7.

Because the adapters Ad10, Ad20, Ad11, Ad12, Ad21, Ad22 are fixed to the arms Ar11, Ar12, Ar21, Ar22, which are used for gripping, in order to grip an object so that the pressure caused by the adapters to the object is levelled out as well as possible, preferably the primary first arm Ar11 is arranged on a same level as the secondary first arm Ar21. More specifically, and with reference to FIG. 7, in an embodiment, a fifth plane Pl5 of which normal is the first direction Dr1 intersects both the primary first arm Ar1 and the secondary first arm Ar21. For similar reasons, in an embodiment, a sixth plane Pl6 of which normal the first direction Dr1 intersects both the primary second arm Ar21 and the secondary second arm Ar22.

The arms Ar11, Ar12, Ar21, Ar22 are reasonably short. This allows for more flexibility in the design of the adapters Ad, Ad10, Ad11, Ad12, Ad20, Ad21, Ad22, Ad30 as discussed above. In particular, the adapters Ad, Ad10, Ad11, Ad12, Ad20, Ad21, Ad22, can be designed more freely in order to grip any types of objects to be driven by the pile driver 10.

In more specific terms and with reference to FIGS. 1*a* and 1 *b*, the primary axis Ax1 is arranged a first distance D1 apart from the secondary axis Ax2. As for a typical size of a pile driver 10, in an embodiment, D1 is from 300 mm to 1500 mm, such as 400 mm to 1000 mm.

As for a typical size in the first direction Dr1, in order to level of the forces generated by the adapter arrangements Aa1, Aa2 to the object, preferably the primary second arm Ar12 is arranged in the first direction DO a distance DO apart from the primary first arm Ar11. The distance DO may be e.g. at least half of the first distance D1. The ratio DO/D1 may be e.g. at least 0.4, such as 0.4 to 4.0.

Moreover, in an embodiment, the primary first arm Ar11 is short in the meaning that a tip T111 of the first part P111 of the primary first arm Ar11 is arranged a second distance D2 apart from the primary axis Ax1 and a ratio D2/D1 of the second distance D2 to the first distance D1 is at most 1.5. In an embodiment, the second distance D2 is equal to or less than the first distance D1; i.e. D2 D1. Thus, the ratio D2/D1 is, in an embodiment, at most 1. In an embodiment, the ratio D2/D1 is, at most 75%.

In an embodiment, this applies to the secondary first arm 21, too. Thus, a tip T121 of the first part P121 of the secondary first arm Ar21 is arranged a third distance D3 apart from the secondary axis Ax2. In an embodiment, a ratio D3/D1 of the third distance D3 and the first distance D1 is at most 1.5. In an embodiment, the third distance D3 is equal to or less than the first distance D1; i.e. D3≤D1. In an embodiment, a ratio D3/D1 of the third distance D3 and the first distance D1 is at most 75%. In an embodiment, the third distance D3 equals the second distance D2.

In an embodiment, this applies to the other arms, too. Thus, a tip T112 of the first part P112 of the primary second arm Ar12 is arranged a fourth distance D4 apart from the primary axis Ax1. In an embodiment, the fourth distance D4 equals the second distance D2. In an embodiment, a ratio D4/D1 of the fourth distance D4 and the first distance D1 is at most 1.5, e.g. at most 1.0 such as at most 75%. In an embodiment, a tip T122 of the first part P122 of the secondary second arm Ar22 is arranged a fifth distance D5 apart from the secondary axis Ax2. In an embodiment, the fifth distance D5 is equal to the third distance D3, which preferably equals the second distance D2. In an embodiment, a ratio D5/D1 of the fifth distance D5 and the first distance D1 is at most 1.5, e.g. at most 1.0 such as at most 75%.

However, the arms Ar11, Ar12, Ar21, Ar22 are, in use, coupled to the adapter arrangements Aa1, Aa2, the adapter arrangements Aa1, Aa2 in effect extending the arms. Thus, the attachments At11, At12, At21, At22 of the arms need to withstand at least some torque, whereby the arms should not be too short. Therefore, in an embodiment, the second distance D2 is at least 15 cm, such as at least 20 cm, e.g. at least 30 cm. For similar reasons, in an embodiment, the third distance D3 is at least 15 cm, such as at least 20 cm, e.g. at least 30 cm. This applies to the distances D4 and D5, too. The minimum of the distance(s) D2 (and D3) depends on the size of the pile driver 10 and on the force generatable by the actuator 21 or the actuator arrangement.

As detailed above, D2 is preferably small with respect to D1, but at the same time reasonable large in absolute terms. Given the numbers above, in some embodiments D1 is, for these reasons, at least 10 cm, preferably at least 15 cm, such as within the limits discussed above. Typical values for D1 were given above.

In an embodiment of the pile driver 10, the arms Ar11, Ar12, Ar21, Ar22 may be changeable, too. Therefore, in an embodiment, the primary first arm Ar11 is attached to the body 11 by a removable pin and a lock, whereby the primary first arm Ar11 is detachable from the body 11 by opening the lock and removing the pin. The pin may form an axle of the primary first pivot Pv11, about which the primary first arm Ar11 is configured to pivot. For similar reasons, in an embodiment, the primary second arm Ar12 is attached to the body 11 by a removable pin and a lock. This pin may, but need not be, a different pin from the one that attaches the primary first arm Ar11 to the body 11. In an embodiment, the secondary first arm Ar21 is attached to the body 11 by a removable pin and a lock. In an embodiment, the secondary second arm Ar22 is attached to the body 11 by a removable pin and a lock. A reasonably long pin may serve as an axle for both the primary first arm Ar11 and the primary second arm Ar12. Thus, the primary first arm Ar11 and the primary second arm Ar12 may both be detached from the body 11 by detaching only one pin. This applies mutatis mutandis to the secondary arms Ar21, Ar22. As detailed above, in such an embodiment, preferably, the primary first arm Ar11 is pivotable about the primary axis Ax1 independently of the primary second arm Ar12, when no adapter is mounted to the vibrator device 10. This applies to the secondary arms Ar21 and Ar22 too, mutatis mutandis.

Referring now to FIGS. 4*a* and 4*b*, an arrangement 20 comprises the pile driver 10, a primary adapter arrangement Aa1, and a secondary adapter arrangement Aa2. In these figures, the primary adapter arrangement Aa1 comprises the primary adapter Ad10 (and may further comprise e.g. bolts B). In these figures, the secondary adapter arrangement Aa2 comprises the secondary adapter Ad20 (and may further comprise e.g. bolts B).

The primary adapter Ad10 is suitable for gripping a first object, e.g. an I-beam, to be driven with the pile driver 10. The primary adapter Ad10 is configured to be fixed both to the primary first attachment At11 of the primary first arm Ar11 and the primary second attachment At12 of the primary second arm Ar12. In this way, when the primary adapter Ad10 is fixed in such a way, the primary adapter Ad10 completes one jaw of the arrangement 20. In an embodiment, the primary adapter Ad10 is configured to grip a planar surface of the first object, such as a planar surface of the I-beam.

The secondary adapter Ad20 is suitable for gripping the first object; i.e. the same object as the primary adapter Ad10. In use of the arrangement at least a part of the first object is arranged in between the primary adapter Ad10 and the secondary adapter Ad20. The secondary adapter Ad20 is configured to be fixed both to the secondary first attachment At21 of the secondary first arm Ar21 and the secondary second attachment At22 of the secondary second arm Ar22.

Preferably, the a shape of the second adapter Ad20 is identical to a shape of the primary adapter Ad10. This has the effect that a lesser number of different kinds of adapters needs to be manufactured, which simplifies the manufacturing process.

Referring to FIG. 8, the primary adapter arrangement Aa1 may comprise a primary first adapter Ad11 and a primary second adapter Ad12, each being configured to be attached to only one arm (Ar11, Ar12). In the embodiment of FIG. 8, the secondary adapter arrangement Aa2 comprises a secondary first adapter Ad21 and a secondary second adapter Ad22, each being configured to be attached to only one arm (Ar21, Ar22).

As detailed above, one purpose of the primary adapter arrangement Aa1 is to extend the arms of the jaws, i.e. to form extensions to both the primary arms Ar11, Ar12.

Thus, in an arrangement 20, the primary adapter arrangement Aa1, e.g. the primary adapter Ad10 or the primary first adapter Ad11, is configured such that when fixed to the to the primary first attachment At11 of the primary first arm Ar11 and the primary second attachment At12 of the primary second arm Ar12, a first part Pad11 of the primary adapter arrangement Aa1 is arranged further away from the primary axis Ax1 than the tip T111 of the first part P111 of the primary first arm Ar11. Referring to what has been said above, tip T111 of the first part P111 of the primary first arm Ar11 is arranged the second distance D2 apart from the primary axis Ax1. Thus, a distance between the first part Pad11 of the primary adapter arrangement Aa1 and the primary axis Ax1 is greater than the second distance D2. In an arrangement 20, the primary adapter arrangement Aa1, e.g. the primary adapter Ad10 or the primary first adapter Ad11, is configured such that when fixed to the to the primary first attachment At11 of the primary first arm Ar11 and the primary second attachment At12 of the primary second arm Ar12, a first part Pad11 of the primary adapter arrangement Aa1 is arranged as far from the primary axis Ax1 as the tip T111 of the first part P111 of the primary first arm Ar11. Thus, a distance between the first part Pad11 of the primary adapter arrangement Aa1 and the primary axis Ax1 is equal to the second distance D2.

In an embodiment, when the primary adapter arrangement Aa1 (comprising the primary adapter Ad10 or the primary adapters Ad11, Ad12) is fixed to the pile driver 10, the first plane Pl1 (see FIG. 7) intersects the first part Pad11 of the primary adapter arrangement Aa1. With reference to FIG. 8, when a primary adapter arrangement Aa1 comprises a primary first adapter Ad11 and a primary second adapter Ad12, a first part Pad11 of the primary adapter arrangement Aa1, in particular, a first part Pad11 of the primary first adapter Ad11, is arranged further away from the primary axis Ax1 than the tip T111 of the first part P111 of the primary first arm Ar11. In an embodiment, the first part Pad11 of the primary adapter arrangement Aa1, in particular, a first part Pad11 of the primary first adapter Ad11, is arranged as far from the primary axis Ax1 as the tip T111 of the first part P111 of the primary first arm Ar11.

Moreover, the primary adapter arrangement Aa1 is configured such that when fixed to the to the primary first attachment At11 of the primary first arm Ar11 and the primary second attachment At12 of the primary second arm Ar12, a second part Pad12 of the primary adapter arrangement Aa1 is arranged further away from the primary axis Ax1 than the tip T112 of the of the first part P112 of the primary second arm Ar12. Referring to what has been said above, the tip T112 of the first part P112 of the primary second arm Ar12 is arranged the fourth distance D4 apart from the primary axis Ax1. Thus, a distance between the second part Pad12 of the primary adapter arrangement Aa1 and the primary axis Ax1 is greater than the fourth distance D4. In an embodiment, when the primary adapter arrangement Aa1 is fixed to the pile driver 10, the second plane Pl2 (see FIG. 7) intersects the second part Pad12 of the primary adapter arrangement Aa1 (e.g. the primary adapter Ad10 thereof or the primary second adapter Ad12 thereof).

For these measures, reference is made to FIG. 4*a*. What has been said applies also for the embodiment of FIG. 8. As for the distances between the arm tips and the primary axis Ax1, reference is made to FIGS. 1*a* and 1 *b*. As conventional, a distance between a part and an axis is the minimum distance between the part and the axis.

This applies also to the secondary adapter arrangement Aa2, of which a purpose is to form extensions to both the secondary arms Ar21, Ar22.

Thus, in an embodiment, the secondary adapter arrangement Aa2 is configured such that when fixed to the to the secondary first attachment At21 of the secondary first arm Ar21 and the secondary second attachment At22 of the secondary second arm Ar22, [i] a first part Pad21 of the secondary adapter arrangement Aa2 is arranged further away from the secondary axis Ax2 than—or as far as from the secondary axis Ax2 as—the tip T121 of the first part P121 of the secondary first arm Ar21 and [ii] a second part Pad22 of the secondary adapter arrangement Aa2 is arranged further away from the secondary axis Ax2 than—or as far as from the secondary axis Ax2 as—the tip T122 of the of the first part P122 of the secondary second arm Ar22. Reference is made to FIG. 4*a*. What has been said applies also for the embodiment of FIG. 8. As for the distances between the arm tips and the secondary axis Ax2, reference is made to FIGS. 1*a* and 1 *b*. As conventional, a distance between a part and an axis is the minimum distance between the part and the axis.

Figure 5A:
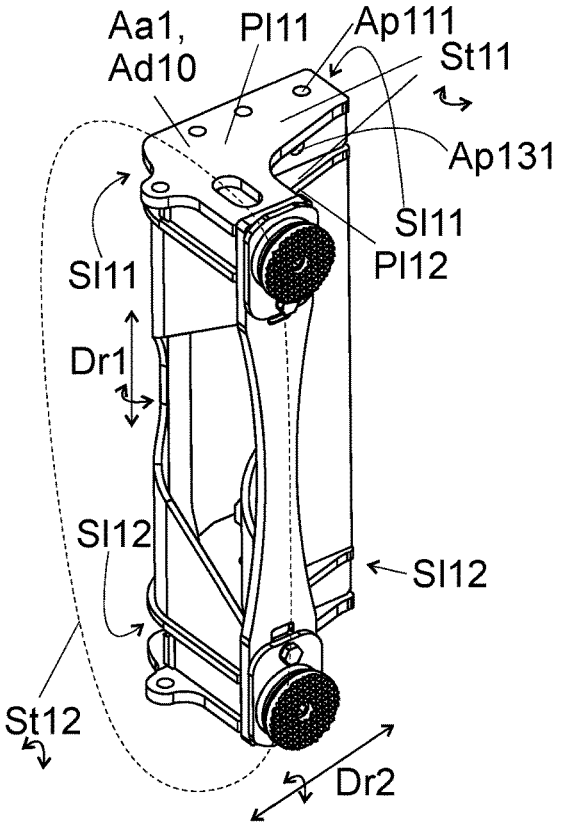
FIG. 5*a* shows a primary adapter in a perspective view.

As indicated above, the adapters of the adapter arrangements Aa1, Aa2 are configured to lengthen the arms of the vibrator device 10. In order to lengthen the arms Ar11, Ar12 so that the object can be gripped with the primary adapter arrangement Aa1, an adapter Ad10, Ad11 of the primary adapter arrangement Aa1 comprises a primary first stiffening member St11. Reference is made to FIG. 5*a*. It is noted that the plates Pl11 and Pl12 of the primary first adapter Ad11 in FIG. 8 form a primary first stiffening member St11 for the same purpose. The primary first stiffening member St11 is configured to stiffen the adapter Ad10, Ad11 of the primary adapter arrangement Aa1 against bending that rises from gripping the object by the primary adapter arrangement Aa1, which is, in use, fixed to the primary arms Ar11, Ar12. Thus primary first stiffening member St11 is configured to stiffen the adapter Ad10, Ad11 of the primary adapter arrangement Aa1 against bending about an axis that is parallel to the first direction Dr1. This bending is shown as a curved double-headed arrow just below the reference St11 in FIG. 5*a*.

In the embodiment of FIG. 5*a* and FIG. 8, the primary first stiffening member St11 comprises a primary first plate Pl11 and a primary second plate Pl12. These plates a planar so that a normal of the plane(s) of the plates Pl11, Pl12 is parallel to the first direction Dr1. Moreover, the primary first plate Pl11 is arranged such a distance apart from the primary second plate Pl12 that a primary first slot Sl11 (better shown in FIG. 5*c*) is arranged between the plates Pl11, Pl12; and a height of the primary first slot Sl11 (as measured in the first direction Dr1) is substantially equal to a thickness of the primary first arm Ar11 of the pile driver 10 (as measured in the first direction Dr1) so that the primary first slot Sl11 is configured to receive the first part P111 of the primary first arm Ar11 of the pile driver 10. It is noted that in FIG. 5*a* the primary first slot Sl11 remains on the back side of the figure and is therefore not shown as clearly as in FIG. 5*c*. In a similar manner, the primary first adapter Ad11 also comprises a primary first slot Sl11 between the plates Pl11 and Pl12 for receiving a part of the arm Ar11.

In the embodiments of FIGS. 5*a* and 8, the primary first stiffening member St11 is arranged at the same level as the primary first arm Ar11. More specifically, the first plane Pl1 (as defined above and shown in FIG. 7) intersects the primary first stiffening member St11 when the primary adapter arrangement Aa1 is fixed to the vibrator unit 10.

Figure 5B:
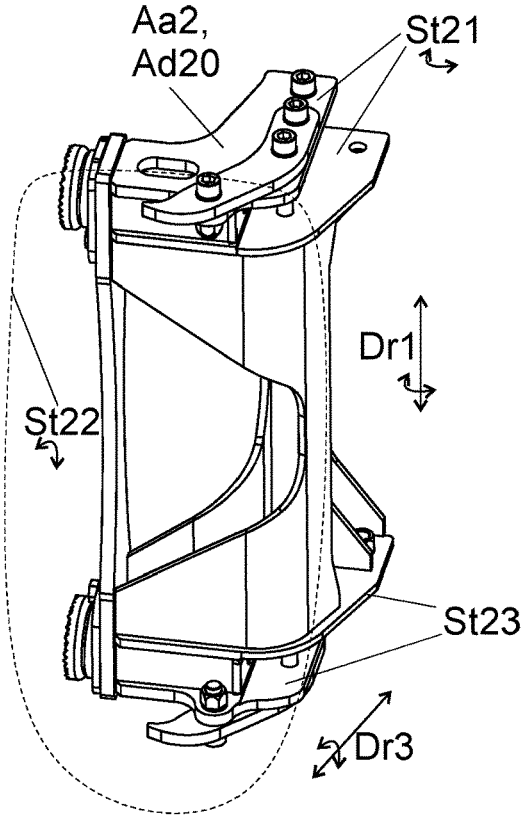
FIG. 5*b* shows a secondary adapter in a perspective view.
Figure 5C:
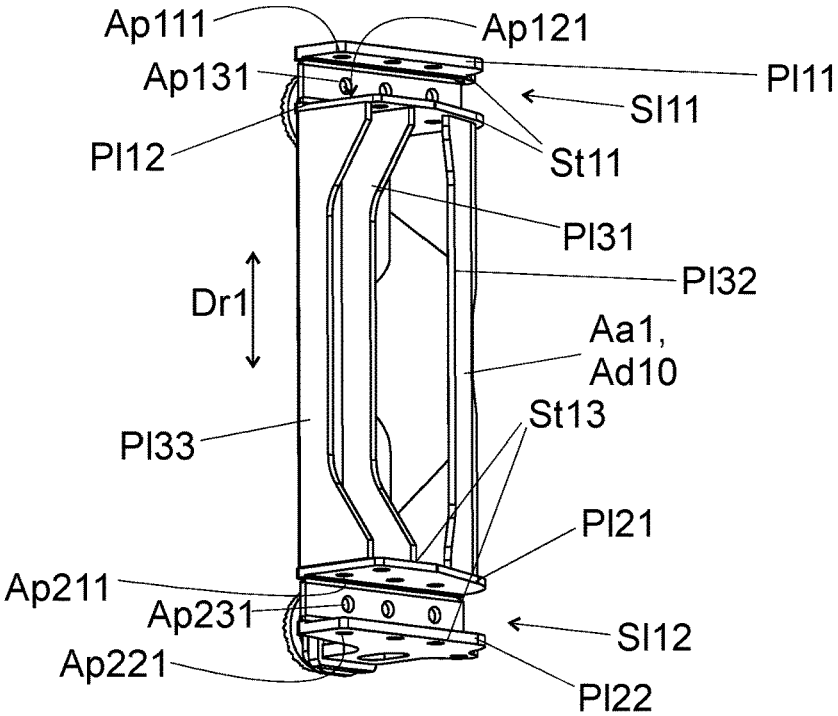
FIG. 5*c* shows the primary adapter of FIG. 5*a* in another perspective view.

In the embodiment of FIGS. 5*a*, 5*c*, and 8 an adapter (e.g. the primary adapter Ad10 or the primary second adapter Ad12) of the primary adapter arrangement Aa1 comprises a primary third stiffening member St13 (see FIG. 5*c*), which has the same function as the primary first stiffening member St11. However, in the embodiment and in use, primary third stiffening member St13 is arranged at the same level as the primary second arm Ar12. More specifically, the second plane Pl2 (as defined below and shown in FIG. 7) intersects the primary third stiffening member St13 when the primary adapter Ad10 is fixed to the vibrator unit 10.

As shown in FIGS. 5*c* and 8, in some embodiments, the primary third stiffening member St13 comprises a secondary first plate Pl21 and a secondary second plate Pl22. These plates a planar so that a normal of the plane(s) of the plates Pl21, P122 is parallel to the first direction Dr1. Moreover, the secondary first plate Pl21 is arranged such a distance apart from the secondary second plate Pl22 that a primary second slot Sl12 is arranged between the plates Pl21, Pl22; and a height of the primary second slot Sl12 (as measured in the first direction Dr1) is substantially equal to a thickness of the primary second arm Ar12 of the pile driver 10 (as measured in the first direction Dr1) so that the primary second slot Sl12 is configured to receive the first part P112 of the primary second arm Ar12 of the pile driver 10.

As detailed above, preferably, the primary arms Ar11, Ar12 of the pile driver operate synchronously together. To this end, in the embodiment of FIG. 8, the pile driver 10 comprises a primary stiffener St01 for the purpose. In the alternative or in addition, such stiffening can be achieved by a stiff adapter.

Thus, in the embodiment of FIGS. 4*b* and 5*a* to 5*c*, the primary adapter Ad10 of the primary adapter arrangement Aa1 is stiff also against bending about an axis that is parallel to a direction Dr2 that is directed from the tip T111 of the first part P111 of the primary first arm Ar11 to the primary axis Ax1 (or reverse thereto, as discussed above for the term "direction"). The direction Dr2 is shown in FIG. 5*a*. Moreover, the bending about this direction is shown as a curved double-headed arrow just below the reference St12. It is also noted that the direction Dr2 is parallel to the direction in which the second distance D2 is defined (see FIG. 1*b*). Thus, in an embodiment, the primary adapter Ad10 of the primary adapter arrangement Aa1 comprises a primary second stiffening member St12 that is configured to stiffen the primary adapter Ad1 against bending about an axis that is parallel to the direction Dr2.

In FIGS. 5*a* and 5*c*, the primary second stiffening member St12 of the primary adapter Ad10 comprises a tertiary first plate Pl31 that is connected to the secondary first plate Pl21 and to the primary second plate Pl12 (see FIG. 5*c*). Moreover, a normal of the a tertiary first plate Pl31 forms a minimum angle of at least 45 degrees (e.g. at least 60 degrees) with the first direction Dr1. Moreover, a normal of the a tertiary first plate Pl31 forms a minimum angle of less than 45 degrees (e.g. less than 60 degrees) with the direction Dr2 as defined above an shown in FIG. 5*a*. The primary second stiffening member St12 may comprise further plates Pl32, Pl33 so that a normal of each of them forms a minimum angle of less than 45 degrees (e.g. less than 60 degrees) with the direction Dr2 as defined above an shown in FIG. 5*a*.

As detailed above, the term "direction" refers to two mutually reverse directions. Therefore, two directions (one of which may be a normal of a plane) define four angles of which at most two are different, as two lines define two different angles or only a straight angle. The term "minimum" angle is used in connection with two directions to clarify that a minimum of these is meant.

What has been said above for the primary adapter arrangement Aa1 applies mutatis mutandis to the secondary adapter arrangement Aa2. Therefore, in an embodiment, an adapter Ad20, Ad21 of the secondary adapter arrangement Aa2 comprises a secondary first stiffening member St21 that is configured to stiffen the adapter Ad20, Ad21 of the secondary adapter arrangement Aa2 against bending about an axis that is parallel to the first direction Dr1. Reference is made to FIG. 5*b*.

Preferably, the secondary first stiffening member St21 comprises a secondary first plate and a secondary second plate similar to the plates Pl11, Pl12. Moreover, a secondary first slot is arranged between the secondary plates so that the secondary first slot is configured to receive the first part P121 of the secondary first arm Ar21 of the pile driver 10.

Moreover, in an embodiment, an adapter Ad20, Ad22 of the secondary adapter arrangement Aa2 comprises a secondary third stiffening member St23 that is configured to stiffen the adapter Ad20, Ad22 of the secondary adapter arrangement Aa2 against bending about an axis that is parallel to the first direction Dr1. Reference is made to FIG. 5*b*.

As detailed above, preferably, the secondary arms Ar21, Ar22 of the pile driver 10 operate synchronously together. To this end, in the embodiment of FIG. 8, the pile driver 10 comprises a secondary stiffener St02 for the purpose. In the alternative or in addition, such stiffening can be achieved by a stiff adapter.

Thus, in an embodiment, a secondary adapter Ad20 of the secondary adapter arrangement Aa20 comprises a secondary second stiffening member St22 that is configured to stiffen the secondary adapter Ad20 against bending about an axis that is parallel to a direction Dr3 that is directed from the tip T121 of the first part P121 of the secondary first arm Ar21 to the secondary axis Ax2 (or reverse thereto, see FIG. 5*b*). The direction Dr3 is shown in FIG. 5*b*. Moreover, the bending about this direction is shown as a curved double-headed arrow just below the reference St22. It is also noted that the direction Dr3 is parallel to the direction is which the third distance D3 is defined (see FIG. 1*b*).

As shown in FIG. 4*b*, the primary adapter arrangement Aa1 is detachable from the pile driver 10. Thus, the adapter arrangement (Aa1, Aa3) fixed to the primary arms Ar11, Ar12 can be changed according to needs. Correspondingly, the secondary adapter arrangement Aa2 fixed to the secondary arms Ar21, Ar22 can be changed according to needs.

Figure 6A:
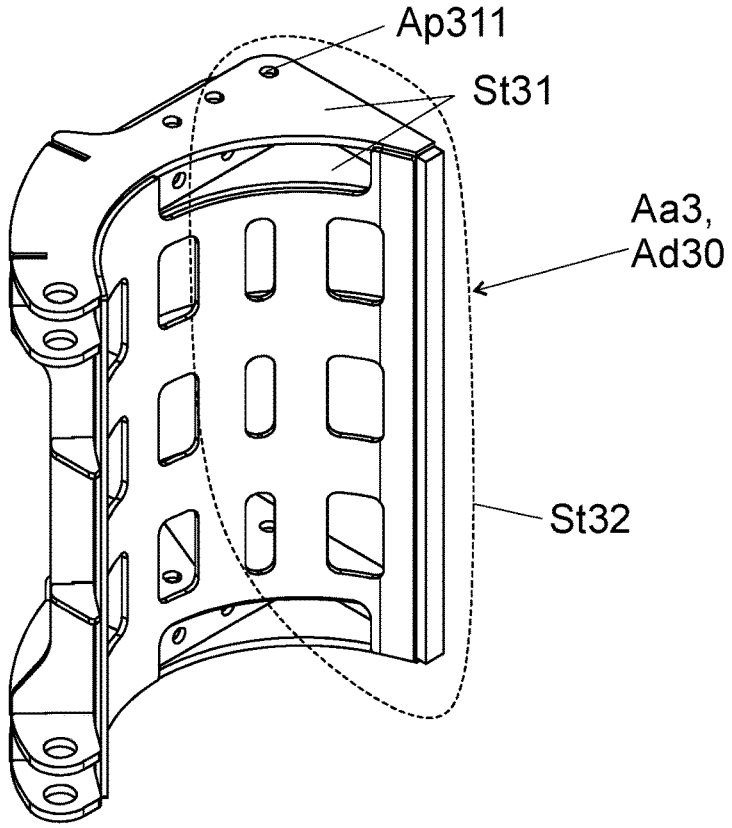
FIG. 6*a* shows a tertiary adapter in a perspective view.
Figure 6B:
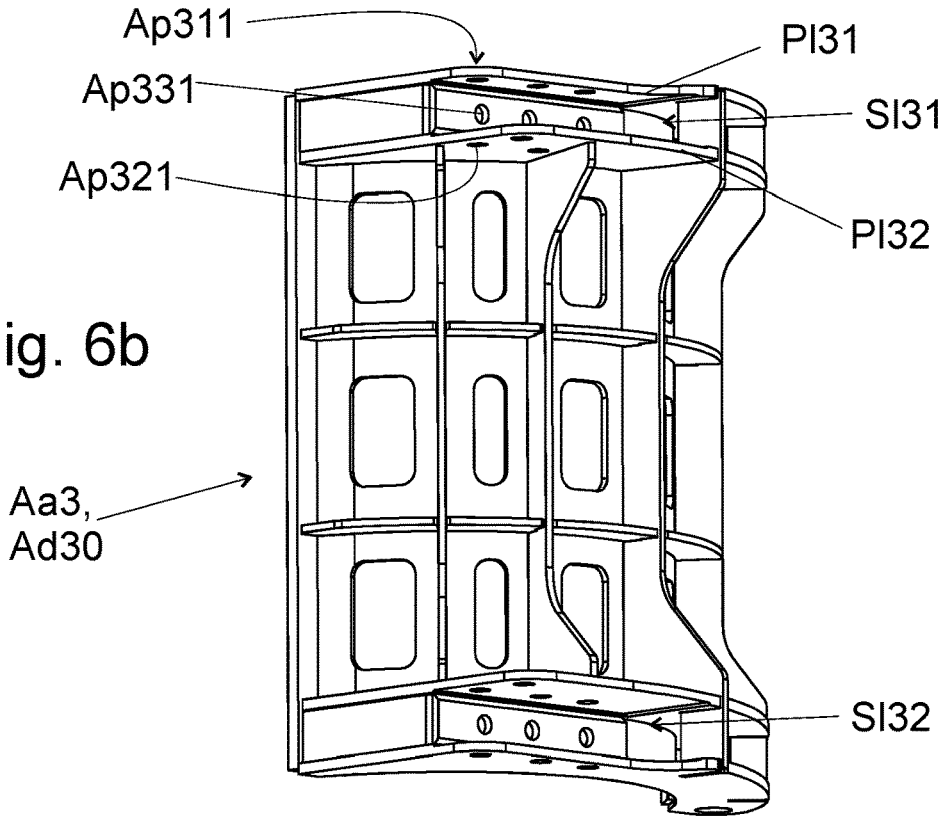
FIG. 6*b* shows a tertiary adapter in another perspective view.

Particularly, the adapters of the adapter arrangements Aa1, Aa2 may be changed for gripping a second object having a different shape from the first object. FIGS. 6*a* and 6*b* show a tertiary adapter Ad30, which is comprised by a tertiary adapter arrangement Aa3. The tertiary adapter Ad30 is attachable to the primary arms Ar11, Ar12 of the pile driver. The tertiary adapter Ad30 shown in FIGS. 6*a* and 6*b* is configured to grip a tubular object. Even if not shown, a tertiary adapter arrangement Aa3 may comprise a tertiary first adapter (e.g. an upper part of the tertiary adapter Ad30 of FIG. 6*a*) and a tertiary second adapter (e.g. a lower part of the tertiary adapter Ad30 of FIG. 6*a*).

Thus, an embodiment of the arrangement 20 further comprises the tertiary adapter arrangement Aa3. The tertiary adapter arrangement Aa3 is arranged to grip a second object to be driven with the pile driver 10. The tertiary adapter arrangement Aa3 is configured to be fixed both to the primary first attachment At11 of the primary first arm Ar11 and the primary second attachment At12 of the primary second arm Ar12. Moreover, a shape of an adapter (e.g. Ad30) of the tertiary adapter arrangement Aa30 is different from a shape an adapter (Ad10, Ad11, Ad12) of the primary adapter arrangement Aa1. This is because the tertiary adapter arrangement Aa3 is usable for gripping such a second object that is different from the first object. Furthermore, only one of the tertiary adapter arrangement Aa3 and the primary adapter arrangement Aa1 at a time is configured to be fixed both to the primary first attachment At11 and the primary second attachment At12. Thus, in the arrangement 20, the primary adapter arrangement Aa1 may be detached and the tertiary adapter arrangement Aa3 attached to the pile driver 10; and/or the tertiary adapter arrangement Aa3 may be detached and the primary adapter arrangement Aa1 attached to the pile driver 10.

In an embodiment, the tertiary adapter is configured to grip a curved surface of the second object, which is tubular.

Preferably the arrangement further comprises a quaternary adapter arrangement for gripping the second object to be driven with the pile driver 10, the quaternary adapter arrangement being configured to be fixed both to the secondary first attachment At21 of the secondary first arm Ar21 and the secondary second attachment At22 of the secondary second arm Ar22 of the pile driver 10. Moreover, a shape of an adapter of the quaternary adapter arrangement is different from a shape of an adapter of the secondary adapter arrangement Aa2. The quaternary adapter arrangement is usable for gripping the same second object that the tertiary adapter arrangement Aa3 is configured to grip. Only one of the quaternary adapter arrangement and the secondary adapter arrangement Aa2 at a time is configured to be fixed both to the secondary first attachment At21 and the secondary second attachment At22. Thus, in the arrangement 20, the secondary adapter arrangement Aa2 may be detached and the quaternary adapter arrangement attached to the pile driver 10; and/or the quaternary adapter arrangement may be detached and the secondary adapter arrangement Aa2 attached to the pile driver 10.

In an embodiment, a shape of an adapter of the quaternary adapter arrangement is identical to a shape an adapter Ad30 of the tertiary adapter arrangement Aa3.

The embodiments concern also an adapter Ad as such. An embodiment of an adapter Ad as such is shown in FIGS. 3*a* and 3*b*. Another embodiment of an adapter Ad as such is shown in FIG. 3*c*. As evident, the adapter Ad of FIGS. 3*a* and 3*b* can be used as the primary adapter Ad10 as discussed; or as the tertiary adapter Ad30, as discussed above. As evident, the adapter Ad of FIG. 3*c* can be used as the primary first adapter Ad11 as discussed; or as the tertiary first adapter, as discussed above.

Thus an adapter Ad is suitable for use with a pile driver 10 as detailed above. The adapter Ad is also suitable for gripping an object to be driven with the pile driver 10. The adapter Ad comprises a first mount Ma1. The first mount Ma1 is configured to be attached to the primary first attachment At11 of the primary first arm Ar11 of the pile driver 10. The adapter Ad comprises a primary first plate Pl11 and a primary second plate Pl12 that is parallel with the primary first plate Pl11 and arranged a distance apart from the primary first plate Pl11 in a primary direction Da1. Thus, a primary first slot Sl11 for receiving a part of the primary first arm Ar11 of a pile driver is arranged between the primary first plate Pl11 and the primary second plate Pl12. As seen from FIGS. 3*a* to 3*c*, 4*a*, and 1*a*, the primary direction Da1 is, when the adapter Ad is fixed to the pile driver 10, parallel to the first direction Dr1. The plates Pl11, Pl12 can be used for mounting. Moreover, in an embodiment, a bottom of the slot extend from the plate Pl11 to the primary second plate Pl12. Thus, also the bottom can be used for mounting.

The adapter Ad comprises a grip surface Gs configured to grip the object to be driven with the pile driver 10. The plates Pl12, Pl12 of the adapter Ad form a first stiffening member St1 that is configured to stiffen the adapter Ad against bending about an axis that is parallel to the primary direction Da1. This is the case in the embodiment of FIG. 3*c* also, even if not shown by the reference St1. It is noted that the primary first stiffening member St11 of the primary adapter Ad10, as disclosed in detail above, forms first stiffening member St1 of a general adapter Ad, when the primary adapter Ad10 is considered as an example of an adapter Ad as such.

In the adapter Ad, the first mount Ma1 extends in a secondary direction Da2. The secondary direction Da2 is perpendicular to the primary direction Da1. The first mount Ma1 of the adapter Ad may comprise apertures that are arranged, relative to each other, in the secondary direction Da2; the apertures being for the purpose of fixing the first mount Ma1 to the primary first attachment At11 of the pile driver. As an example, FIGS. 3*a* and 3*c* show the apertures Ap11, Ap14, and Ap15 that are arranged, relative to each other, in the secondary direction Da2.

Referring to FIGS. 3, 4*a*, 1 *b*, and 8 when the adapter Ad is fixed to the pile driver 10, the secondary direction Da2 may be parallel or it may form a small minimum angle (say at most 30 degrees) with the direction in which the second distance D2 is measured (i.e. the second direction Dr2 defined above in the context of the pile driver 10).

To extend the arm or the arms to which the adapter is fixed, the adapter Ad extends in the secondary direction Da2 beyond the first mount Ma1. Thus, a measure of the adapter Ad in the secondary direction Da2 is greater than a measure of only the first mount in this direction. Thereby the extension of the arm(s) is achieved.

Referring to what has been said above, in an embodiment, a first part Pad11 of the adapter Ad, Ad10, Ad11, Ad12 is arranged further away from a primary axis Ax1, about which the primary first arm Ar11 of a pile driver 10 pivots, than a tip T111 of a first part P111 of the primary first arm Ar11. Herein first part P111 of the primary first arm Ar11 comprises the primary first attachment At11 to which the first mount Ma1 if configured to be attached. In an embodiment, the first part Pad11 of the adapter Ad, Ad10, Ad11, Ad12 is arranged as far from the primary axis Ax1, about which the primary first arm Ar11 of a pile driver 10 pivots, as the tip T111 of a first part P111 of the primary first arm Ar11. Moreover, preferably, the grip surface Gs comprises the first part Pad11 of the adapter Ad, Ad10, Ad11, Ad12. Thus, preferably at least a part of the grip surface Gs is, in use, arranged further away from the primary axis Ax1 than the tip T111 of the primary first arm Ar11; or at least as far.

Referring particularly to FIGS. 3*a* and 3*b*, an embodiment of the adapter Ad comprises a second mount Ma2. The second mount Ma2 is configured to be attached to the primary second attachment At12 of the primary second arm Ar12 of the pile driver 10. The second mount Ma2 is arranged a distance Dma apart from the first mount Ma1 in the primary direction Da1.

In this embodiment, the adapter Ad preferable comprises a second stiffening member St2 that is configured to stiffen the adapter Ad against bending about an axis that is parallel to the secondary direction Da2. It is noted that the primary second stiffening member St12 of the primary adapter Ad10, as disclosed in detail above, forms second stiffening member St2 of a general adapter Ad, when the primary adapter Ad10 is considered as an example of an adapter Ad as such.

Referring to FIG. 3*a* in an embodiment, the adapter Ad is symmetric about a plane Sp of which normal is the primary direction Da1. Even if not shown, this applies to FIG. 3*c*, too. In some embodiments, this applies also to the primary, secondary, tertiary, and quaternary adapters Ad10, Ad20, and Ad30 as discussed above. Having a symmetric shape is preferable, because, when the opposing adapters (e.g. primary adapter 10 and secondary adapter 20; or tertiary and quaternary adapters) are similar or identical, the symmetric form decreases torque generated to the object by the adapters. Moreover, the opposing adapters preferably are similar because of manufacturing reasons. However, this issue is less important if the adapter comprises only one mount Ma1, whereby the pile driver 10 may comprise a stiffener St01, St02 (FIG. 8).

As discussed, the adapters Ad, Ad10, Ad11, Ad12, Ad20, Ad21, Ad22, Ad30 are attachable to the pile driver 10 and detachable therefrom. Referring to FIG. 4*b*, preferably, the adapter is attachable to the pile driver 10 by using at least bolts. Thus, the attachments At11, At12, At21, At22 of the pile driver 10 preferably comprise holes, e.g. through holes or blind holes, for attaching the adapters. FIG. 4*b* shows mounting in such a case, where the attachments At11, At12, At21, At22 comprise through holes. In the embodiment of FIG. 4*b*, the adapters are attachable to the pile driver 10 by using bolts and nuts. In another embodiment (not shown), the attachments At11, At12, At21, At22 of the pile driver 10 comprise blind holes that are threaded on their inner surface. Thus, the bolts may be screwed to the blind holes of the attachments. Moreover, through holes may be threaded, whereby even if through holes are used, bolts may be used without nuts.

In line with these principles and with reference to FIGS. 1*a* and 1 *b*, in an embodiment, the primary first attachment At11 of the primary first arm Ar11 comprises a primary first primary hole H111. In line with what has been said above, the primary first primary hole H111 may be a through hole or a blind hole. The primary first primary hole H111 extends into the primary first arm Ar11 in a direction, say primary first primary direction of extension. In the embodiments, a cross section of the primary first primary hole H111 is circular, wherein the cross section is defined on a plane of which normal is the primary first primary direction of extension. Thus, the primary first primary hole H111 has a circular profile that extends in the primary first primary direction of extension. In an embodiment, the primary first primary direction of extension that forms a minimum angle of at most 60 degrees, preferably at most 15 degrees, with the first direction Dr1. In the embodiment of FIGS. 1*a* and 1*b*, the primary first primary direction is parallel to the first direction Dr1.

As shown in FIGS. 4*b* and 8, a first primary first aperture Ap111 of the primary adapter Ad10 or the primary first adapter Ad11 is configured to function together with the primary first primary hole H111 of the primary first attachment At11. Thus, the primary first stiffening member St11 of the primary adapter Ad10 or primary first adapter Ad11 can be reliably fixed to the primary first attachment At11. In particular, the primary first plate Pl11 of the primary adapter Ad10 or primary first adapter Ad11 can be reliably fixed to the primary first attachment At11. As detailed above, a bolt may penetrate the first primary first aperture Ap111 into the primary first primary hole H111 in the primary first primary direction of extension. The bolt may penetrate through the arm Ar11 as depicted in FIG. 4*b*, or the primary first primary hole H111 may have threads to which the bolt is screwed, in the bolt may penetrate into the arm Ar11.

Referring to FIGS. 1*a* and 1*b*, in an embodiment, the primary first attachment At11 of the primary first arm Ar11 comprises a primary first secondary hole H112 extending into the primary first arm Ar11 in a direction, say primary first secondary direction of extension. In the embodiments, a cross section of the primary first secondary hole H112 is circular, wherein the cross section is defined on a plane of which normal is the primary first secondary direction of extension. Thus, the primary first secondary hole H112 has a circular profile that extends in the primary first secondary direction of extension. In an embodiment, the primary first secondary direction forms a minimum angle of at least 30 degrees, preferably at least 75 degrees, with the first direction Dr1. In the embodiments of FIGS. 1*a* and 1 *b*, the primary first secondary direction is perpendicular to the first direction. In addition, preferably, the primary first secondary direction of extension forms a minimum angle of at least 60 degrees with a direction that is directed from the primary first secondary hole H112 to the primary axis Ax1.

As shown in FIGS. 4*b* and 8, a first tertiary first aperture Ap131 of the primary adapter Ad10 or the primary first adapter Ad11 is configured to function together with the primary first secondary hole H112 of the primary first attachment At11. Thus, the primary first stiffening member St11 of the primary adapter Ad10 or the primary first adapter Ad11 can be even more reliably fixed to the primary first attachment At11, because the bolts used in connection with both the holes H112 and H112 are directed in different directions thereby ensuring a strong attachment in more than one directions. As detailed above, a bolt may penetrate the first tertiary first aperture Ap131 into the primary first secondary hole H112 in the primary first secondary direction of extension. The bolt may penetrate through the arm Ar11 as depicted in FIG. 4*b*, or the primary first secondary hole H112 may have threads to which the bolt is screwed.

In an embodiment, the primary first primary hole H111 extends through the primary first arm Ar11. However, the primary first primary hole H111 need not extend through the primary first arm Ar11. Instead, and with reference to FIGS. 2*a* and 2*b*, the primary first primary hole H111 may be a blind hole. In such a case, preferably, the primary first attachment At11 of the primary first arm Ar11 comprises a primary first tertiary hole H113 extending into the primary first arm. As shown in FIGS. 2*a* and 2*b*, the primary first tertiary hole H113 extends into the primary first arm from an opposite side than the primary first primary hole H111. Therefore, the primary first primary hole H111 and primary first tertiary hole H113 are arranged on opposite sides of the first plane Pl1, which intersects the primary first pivot Pv11 and of which normal is the first direction Dr1.

The primary first tertiary hole H113 extends into the primary first arm Ar11 in a primary first tertiary direction of extension. The primary first tertiary direction of extension forms a minimum angle of at most 60 degrees, preferably at most degrees, with the first direction Dr1. The primary first tertiary direction of extension may be parallel with the first direction Dr1. The primary first primary hole H111 and the primary first tertiary hole H113 need not be arranged on a same axis, which is parallel to the first direction Dr1.

As readable from FIG. 5*c*, a first secondary first aperture Ap121 (corresponding to the aperture Ap12 of FIG. 3*b*) of the primary adapter Ad10 is configured to function together with either [A] the primary first primary hole H111 of the primary first attachment At11 (in case the primary first primary hole H111 is a through hole) or [B] the primary first tertiary hole H113 of the primary first attachment At11 (in case the primary first primary hole H111 is a blind hole). In a similar manner, in the embodiment of FIG. 8 a first secondary first aperture (not shown for technical reasons) of the primary first adapter Ad11 is configured to function together with either [A] the primary first primary hole H111 of the primary first attachment At11 (in case the primary first primary hole H111 is a through hole) or [B] the primary first tertiary hole H113 of the primary first attachment At11 (in case the primary first primary hole H111 is a blind hole).

Thus, the primary first stiffening member St11 of the primary adapter Ad10 or the primary first adapter Ad11 can be reliably fixed to the primary first attachment At11. In particular, the primary second plate Pl12 of the primary adapter Ad10 or primary first adapter Ad11 the can be reliably fixed to the primary first attachment At11.

The primary second arm Ar12 preferably has similar holes.

Thus, preferably, the primary second attachment At12 of the primary second arm Ar12 comprises a primary second primary hole H121 extending into the primary second arm Ar12 in a primary second primary direction of extension. The primary second primary direction of extension forms a minimum angle of at most 60 degrees, preferably at most 15 degrees, with the first direction Dr1. The primary second primary direction of extension is defined as a direction of the central axis of the circular primary second primary hole H121 in a similar way as discussed above in connection with the hole H111.

Moreover, the primary second attachment At12 of the primary second arm Ar12 preferably comprises a primary second secondary hole H122 extending into the primary second arm Ar12 in a primary second secondary direction of extension. The primary second secondary direction of extension forms a minimum angle of at least 30 degrees, preferably at least 75 degrees, with the first direction Dr1. The primary second secondary direction of extension is defined as a direction of the central axis of the circular primary second secondary hole H122 in a similar way as discussed above in connection with the hole H112. Preferably, the primary second secondary direction of extension forms a minimum angle of at least 60 degrees with a direction that is directed from the primary second secondary hole H122 to the primary axis Ax1.

In an embodiment, the primary second primary hole H121 extends through the primary second arm Ar12. However, the primary second primary hole H121 needs not extend through the primary second arm Ar12. Instead, and with reference to FIGS. 2*a* and 2*b* mutatis mutandis, the primary second primary hole H121 may be a blind hole. In such a case, preferably, the primary second attachment At12 of the primary second arm Ar12 comprises a primary second tertiary hole (not shown) extending into the primary second arm Ar12. The primary second tertiary hole extends into the primary second arm Ar12 from an opposite side than the primary second primary hole H121. Therefore, the primary second primary hole H121 and primary second tertiary hole are arranged on opposite sides of the second plane Pl2, which intersects the primary second pivot Pv12 and of which normal is the first direction Dr1.

What has been said about the holes of the attachment At11 of the primary first arm Ar11 applies, in an embodiment and mutatis mutandis, to the attachment At21 of the secondary first arm Ar21.

Therefore, in an embodiment, the secondary first attachment At21 of the secondary first arm Ar21 comprises a secondary first primary hole H211 extending into the secondary first arm Ar21 in direction that forms a minimum angle of at most 60 degrees, preferably at most 15 degrees, or is parallel, with the first direction Dr1.

Moreover, the secondary first attachment At21 of the secondary first arm Ar21 comprises a secondary first secondary hole H212 extending into the secondary first arm Ar21 in a direction that forms a minimum angle of at least degrees, preferably at least 75 degrees, or about 90 degrees, with the first direction Dr1. Furthermore, the direction to which the secondary first secondary hole H212 extends forms a minimum angle of at least 60 degrees with a direction that is directed from the secondary first secondary hole H212 to the secondary axis Ax2.

The secondary first attachment At21 of the secondary first arm Ar21 may comprise a secondary first tertiary hole (not shown) extending into the secondary first arm Ar21. The secondary first tertiary hole extends into the secondary first arm from an opposite side than the secondary first primary hole H211.

What has been said about the holes of the attachment At12 of the primary second arm Ar12 applies, in an embodiment and mutatis mutandis, to the attachment At22 of the secondary second arm Ar22.

Therefore, in an embodiment, the secondary second attachment At22 of the secondary second arm Ar22 comprises a secondary second primary hole H221 extending into the secondary second arm Ar22 in a direction that forms a minimum angle of at most 60 degrees, preferably at most 15 degrees, or is parallel, with the first direction Dr1.

Moreover, in an embodiment, the secondary second attachment At22 of the secondary second arm Ar22 comprises a secondary second secondary hole H222 extending into the secondary second arm Ar22 in a direction that forms a minimum angle of at least 30 degrees, preferably at least 75 degrees, e.g. about 90 degrees with the first direction Dr1. Preferably, the direction to which the secondary second secondary hole H222 extends forms an angle of at least 60 degrees with a direction that is directed from the secondary second secondary hole H222 to the secondary axis Ax2.

The secondary second attachment At22 of the secondary second arm Ar22 may comprise a secondary second tertiary hole extending into the secondary second arm Ar22. The secondary second tertiary hole extends into the secondary second arm from an opposite side than the secondary second primary hole H221.

The holes of the primary attachments At11, At12 of the primary arms Ar11, Ar12 are configured to operate in connection with apertures of the primary adapter arrangement Aa1. Moreover, in an embodiment the first parts P111, P112 of the primary arms Ar11, Ar12 are configured operate in connection with the slots Sl1, Sl2 of the primary adapter 10 of the primary adapter arrangement Aa1 (FIG. 4*b*). In an embodiment the first part P111 of the primary first arm Ar11 is configured operate in connection with the slot Sl1 of the primary first adapter Ad11 of the primary adapter arrangement Aa1 and the first part P112 of the primary second arm Ar12 is configured operate in connection with the slot of the primary second adapter Ad12 of the primary adapter arrangement Aa1 (FIG. 8).

The holes of the secondary attachments At21, At22 of the secondary arms Ar21, Ar22 are configured to operate in connection with apertures of the secondary adapter Ad20.

Therefore, concerning an adapter Ad, in an embodiment the first primary plate Pl11 comprises a first primary first aperture Ap111, which is a through hole in the primary plate Pl11. The first primary first aperture Ap111 is configured to operate in connection with the primary first primary hole H111 of the primary first attachment At11 of the primary first arm Ar11. Moreover, a bottom of the primary first slot Sl11 is provided with a first tertiary first aperture Ap131. The first tertiary first aperture Ap131 is a through hole. The first tertiary first aperture Ap131 is configured to operate in connection with the primary first secondary hole H112 of the primary first attachment At11 of the primary first arm Ar11.

Preferably, the first secondary plate Pl12 comprises a first secondary first aperture Ap121. The first secondary first aperture Ap121 is configured to operate in connection with [A] the primary first primary hole H111 (in case the primary first primary hole H111 is a through hole) of the primary first attachment At11 of the primary first arm Ar11 or [B] the primary first tertiary hole H113 of the primary first attachment At11 of the primary first arm Ar11 (in case the primary first primary hole H111 is a blind hole).

Concerning an adapter Ad, such as the primary adapter Ad10 in particular the second mount Ma2 thereof as the case may be, in an embodiment, the primary adapter Ad10 comprises the primary second slot Sl12 in between a second primary plate Pl21 and a second secondary plate Pl22. The primary second slot Sl12 is configured to receive a part of the primary second arm Ar12. The primary second slot Sl12 may be configured to receive the first part P112 of the primary second arm Ar12. The second primary plate Pl21 comprises a second primary first aperture Ap211. The second primary first aperture Ap211 is configured to operate in connection with the primary second primary hole H121 of the primary second attachment At12 of the primary second arm Ar12. Moreover, a bottom the primary second slot Sl12 is provided with second tertiary first aperture Ap231 that is configured to operate in connection with the primary second secondary hole H122 of the primary second attachment At12 of the primary second arm Ar12.

Preferably, the first secondary plate Pl22 comprises a second secondary first aperture Ap221. The second secondary first aperture Ap221 is configured to operate in connection with [A] the primary second primary hole H121 (in case the primary second primary hole H121 is a through hole) of the primary first attachment At11 of the primary first arm Ar11 or [B] the primary second tertiary hole H123 of the primary first attachment At11 of the primary first arm Ar11 (in case the primary second primary hole H121 is a blind hole).

Concerning the adapter Ad as such and with reference to FIGS. 3*a* and 3*b*, in an embodiment, the first mount Ma1 of the adapter Ad comprises a first primary aperture (Ap11, Ap111) extending through a part of the adapter (Ad, Ad10, Ad11, Ad12, Ad30) in a direction that forms a minimum angle of at most 60 degrees, preferably at most 15 degrees, most preferably parallel, with the primary direction Da1.

Concerning the adapter Ad as such, in an embodiment, the first mount Ma1 of the adapter Ad comprises a first tertiary aperture (Ap13, Ap131) extending through a part of the adapter (Ad, Ad10, Ad30) in a direction that

- forms a minimum angle of at least 30 degrees, preferably at least 75 degrees, for example is perpendicular, with the primary direction Da1 and
- forms a minimum angle of at least 30 degrees, preferably at least 75 degrees, with the secondary direction Da2.

In an embodiment, the first mount Ma1 of the adapter Ad comprises a first secondary aperture (Ap12, Ap121) extending through a part of the adapter (Ad, Ad10, Ad30) in a direction that forms a minimum angle of at most 60 degrees, preferably at most 15 degrees, most preferably parallel, with the primary direction Da1.

The first primary aperture (Ap11, Ap111), the first secondary aperture (Ap12, Ap121), and the first tertiary aperture (Ap13, Ap131) are configured to operate with holes of attachments of a pile driver.

Concerning the adapter Ad as such, in an embodiment, the second mount Ma2 of the adapter Ad comprises a second primary aperture (Ap21, Ap211) extending through a part of the adapter (Ad, Ad10, Ad30) in a direction that forms a minimum angle of at most 60 degrees, preferably at most 15 degrees, most preferably parallel, with the primary direction Da1.

Concerning the adapter Ad as such, in an embodiment, the second mount Ma2 of the adapter Ad comprises a second tertiary aperture (Ap23, Ap231) extending through a part of the adapter (Ad, Ad10, Ad30) in a direction that

- forms a minimum angle of at least 30 degrees, preferably at least 75 degrees, for example is perpendicular, with the primary direction Da1 and
- forms a minimum angle of at least 30 degrees, preferably at least 75 degrees, with the secondary direction Da2.

In an embodiment, the second mount Ma2 of the adapter Ad comprises a second secondary aperture (Ap22, Ap221) extending through a part of the adapter (Ad, Ad10, Ad30) in a direction that forms a minimum angle of at most 60 degrees, preferably at most 15 degrees, most preferably parallel, with the primary direction Da1.

The second primary aperture (Ap21, Ap211), the second secondary aperture (Ap22, Ap221), and the second tertiary aperture (Ap23, Ap231) are configured to operate with holes of attachments of a pile driver.

Referring to FIG. 4*b*, in an embodiment, an adapter of the primary adapter arrangement Aa1 is configured to be attached to the to the primary first attachment At11 of the primary first arm Ar11 by nuts N and bolts B. This applies, when the holes (H111, H112, H121, H122) of the primary first arm Ar11 are through holes. However, as detailed above, the holes (H111, H112, H121, H122) of the primary arms Ar11, Ar12 may be blind holes. The blind holes may comprise threads for bolts. Then the bolts B may be screwed to the holes directly without nuts. Moreover, even if the holes (H111, H112, H121, H122) of the primary first arm Ar11 are through holes, they may be provided with threads for bolts. Also in such a case, bolts may be used without nuts. Thus, in an embodiment, an adapter of the primary adapter arrangement Aa1 is configured to be attached to the to the primary first attachment At11 of the primary first arm Ar11 by bolts B only. In an embodiment, an adapter of the primary adapter arrangement Aa1 is configured to be attached to the primary first attachment At11 of the primary first arm Ar11 by at least bolts B.

Moreover, the adapter of the primary adapter arrangement Aa1 is configured to be detached from the primary first attachment At11 by opening the bolts B (e.g. from the nuts N or from the threaded holes).

In a similar manner, in an embodiment, an adapter of the secondary adapter arrangement Aa2 is configured to be attached to the to the secondary first attachment At21 of the secondary first arm Ar21 by at least bolts B. Thereby the adapter of the secondary adapter arrangement Aa2 is configured to be detached from the secondary first attachment At21 by opening the bolts B.

The inventors note that the features disclosed above and in the dependent claims in combination with the small ratio D2/D1 are usable also in solutions wherein the ratio is larger. In particular, the features disclosed above and in the dependent claims are usable in the context of a pile driver (10) for driving piles into ground, the pile driver (10) comprising

- a body (11) attachable to a power tool,
- a vibrator unit (12) attached to the body (11),
- a primary first arm (Ar11) and a primary second arm (Ar12), the primary first arm (Ar11) and the primary second arm (Ar12) being pivotable about a primary axis (Ax1), the primary axis (Ax1) being arranged in a first direction (Dr1),
- a secondary first arm (Ar21) and a secondary second arm (Ar22), the secondary first arm (Ar21) and the secondary second arm (Ar22) being pivotable about a secondary axis (Ax2), the secondary axis (Ax2) being parallel with the primary axis (Ax1),
- an actuator (21) or actuator arrangement for pivoting [a] at least one of the primary first arm (Ar11) and the primary second arm (Ar12) and [b] at least one of the secondary first arm (Ar21) and the secondary second arm (Ar22), wherein
- a first part (P111) of the primary first arm (Ar11) is provided with a primary first attachment (At11), and the primary axis (Ax1) is arranged a first distance (D1) apart from the secondary axis (Ax2).

The invention claimed is:

1. An arrangement comprising:

a pile driver for driving piles into ground, the pile driver comprising a body attachable to a power tool, a vibrator unit attached to the body, a primary first arm and a primary second arm, the primary first arm and the primary second arm being pivotable about a primary axis, the primary axis being arranged in a first direction, a secondary first arm and a secondary second arm, the secondary first arm and the secondary second arm being pivotable about a secondary axis, the secondary axis being parallel with the primary axis, an actuator or actuator arrangement for pivoting [a] at least one of the primary first arm and the primary second arm and [b] at least one of the secondary first arm and the secondary second arm, wherein a first part of the primary first arm is provided with a primary first attachment for attaching an adapter suitable for gripping an object to be driven with the pile driver the primary axis is arranged a first distance apart from the secondary axis, and a tip of the first part of the primary first arm is arranged a second distance apart from the primary axis such that a ratio of the second distance to the first distance is equal to or less than 1.5;

the arrangement further comprising:

a primary adapter arrangement for gripping a first object to be driven with the pile driver, the primary adapter arrangement being configured to be fixed both to the primary first attachment of the primary first arm and a primary second attachment of the primary second arm, a secondary adapter arrangement for gripping the first object such that at least a part of the first object is arranged in between the primary adapter arrangement and the secondary adapter arrangement, the secondary adapter arrangement being configured to be fixed both to a secondary first attachment of the secondary first arm and a secondary second attachment of the secondary second arm, a primary stiffener configured to couple the primary first arm and the primary second arm such that the primary first arm and the primary second arm pivot together, and a secondary stiffener configured to couple the secondary first arm and the secondary second arm such that the secondary first arm and the secondary second arm pivot together;

wherein the primary adapter arrangement comprises:

a first mount configured to be fixed to the primary first attachment, and a second mount configured to be fixed to the primary second attachment.

2. The arrangement of claim 1, wherein the second distance is at least 15 cm.

3. The arrangement of claim 1, wherein a shape of an adapter of the secondary adapter arrangement is identical to a shape of an adapter of the primary adapter arrangement and/or a shape of an adapter of at least one of the adapter arrangements is symmetric about a plane.

4. The arrangement of claim 1, wherein the primary adapter arrangement is configured such that when fixed to the to the primary first attachment of the primary first arm and the primary second attachment of the primary second arm, a first part of the primary adapter arrangement is arranged further away, or as far, from the primary axis than/as the tip of the first part of the primary first arm and a second part of the primary adapter arrangement is arranged further away, or as far, from the primary axis than/as a tip of a first part of the primary second arm, the first part of the primary second arm comprising the primary second attachment; and the secondary adapter arrangement is configured such that when fixed to the to the secondary first attachment of the secondary first arm and the secondary second attachment of the secondary second arm, a first part of the secondary adapter arrangement is arranged further away, or as far, from the secondary axis than/as a/the tip of a/the first part of the secondary first arm and a second part of the secondary adapter arrangement is arranged further away, or as far, from the secondary axis than/as a tip of a first part of the secondary second arm.

5. The arrangement of claim 1, wherein the first mount comprises a primary first slot arranged between a first primary plate and a first secondary plate.

6. The arrangement of claim 5, wherein the first primary plate comprises a first primary first aperture such that the first primary first aperture is configured to operate in connection with a primary first primary hole of the primary first attachment of the primary first arm, a bottom of the primary first slot is provided with a first quaternary first aperture that is configured to operate in connection with a primary first secondary hole of the primary first attachment of the primary first arm, and the first secondary plate comprises a first secondary first aperture such that the first secondary first aperture is configured to operate in connection with a primary first primary hole or a primary first tertiary hole of the primary first attachment of the primary first arm.

7. The arrangement of claim 1, wherein the primary adapter arrangement comprises a primary first stiffening member that is configured to stiffen an adapter of the primary adapter arrangement against bending about an axis that is parallel to the first direction and the secondary adapter arrangement comprises a secondary first stiffening member that is configured to stiffen an adapter of the secondary adapter arrangement against bending about an axis that is parallel to the first direction.

8. The arrangement of claim 1, wherein the primary adapter arrangement comprises a primary adapter comprising a primary second stiffening member that is configured to stiffen the primary adapter against bending about an axis that is parallel to a direction that is directed from the tip of the first part of the primary first arm to the primary axis, or the primary stiffener is fixed to the primary first arm and the primary second arm; and the secondary adapter arrangement comprises a secondary adapter comprising a secondary second stiffening member that is configured to stiffen the secondary adapter against bending about an axis that is parallel to a direction that is directed from a tip of the first part of the secondary first arm to the secondary axis or the secondary stiffener is fixed to the secondary first arm and the secondary second arm.

9. The arrangement of claim 1, wherein an adapter of the primary adapter arrangement is configured to be attached to the to the primary first attachment of the primary first arm by at least bolts, whereby the adapter of the primary adapter arrangement is configured to be detached from the primary first attachment by opening the bolts.

10. The arrangement of claim 1, comprising a tertiary adapter arrangement for gripping a second object to be driven with the pile driver, the tertiary adapter arrangement being configured to be fixed both to the primary first attachment of the primary first arm and the primary second attachment of the primary second arm, wherein a shape of an adapter of the tertiary adapter arrangement is different from a shape of an adapter of the primary adapter arrangement for gripping such a second object that is different from the first object, and only one of the tertiary adapter arrangement and the primary adapter arrangement at a time is configured to be fixed both to the primary first attachment and the primary second attachment.

11. The arrangement of claim 1, wherein the primary first arm is configured to pivot about a primary first pivot, the primary second arm is configured to pivot about a primary second pivot, and the vibrator unit is arranged between a first plane and a second plane, wherein the first direction is normal to the first plane and the first plane intersects the primary first pivot and the first direction is normal to the second plane and the second plane intersects the primary second pivot.

12. The arrangement of claim 11, wherein the secondary first arm is configured to pivot about a secondary first pivot, the secondary second arm is configured to pivot about a secondary second pivot, and the vibrator unit is arranged between a third plane and a fourth plane, wherein, the first direction is normal to the third plane and the third plane intersects the secondary first pivot and the first direction is normal to the fourth plane and the fourth plane intersects the secondary second pivot.

13. The arrangement of claim 1, wherein the primary first attachment of the primary first arm comprises a primary first primary hole extending into the primary first arm in a direction that forms a minimum angle of at most 15 degrees, with the first direction, and a primary first secondary hole extending into the primary first arm in a direction that forms a minimum angle of at least 75 degrees, with the first direction, and the primary second attachment of the primary second arm comprises a primary second primary hole extending into the primary second arm in a direction that forms a minimum angle of at most 15 degrees, with the first direction and a primary second secondary hole extending into the primary second arm in a direction that forms a minimum angle of at least 75 degrees, with the first direction.

14. The arrangement of claim 13, wherein

[A]

the primary first primary hole extends through the primary first arm or

[B]

the primary first attachment of the primary first arm comprises a primary first tertiary hole extending into the primary first arm in a direction that forms a minimum angle of at most 15 degrees, with the first direction such that the primary first primary hole and primary first tertiary hole are arranged on opposite sides of a first plane that intersects a primary first pivot, wherein the primary first arm is configured to pivot about the primary first pivot, and the first direction is normal to the first plane.

15. The arrangement of claim 13, wherein the direction to which the primary first secondary hole extends forms a minimum angle of at least 60 degrees with a direction that is directed from the primary first secondary hole to the primary axis and the direction to which the primary second secondary hole extends forms a minimum angle of at least 60 degrees with a direction that is directed from the primary second secondary hole to the primary axis.

16. The arrangement of claim 1, wherein the primary first attachment of the primary first arm comprises a primary first primary hole extending into the primary first arm in a direction that forms a minimum angle of at most 15 degrees with the first direction or a primary first secondary hole extending into the primary first arm in a direction that forms a minimum angle of at least 75 degrees, with the first direction, and the primary second attachment of the primary second arm comprises a primary second primary hole extending into the primary second arm in a direction that forms a minimum angle of at most 15 degrees, with the first direction or a primary second secondary hole extending into the primary second arm in a direction that forms a minimum angle of at least 75 degrees, with the first direction.

17. The arrangement of claim 1, wherein the primary adapter arrangement comprises an adaptor and a first part of the adapter is arranged further away from the primary axis than the tip of the first part of the primary first arm, the first part of the primary first arm comprising the primary first attachment.

18. The arrangement of claim 1, wherein the primary adapter arrangement comprises an adapter comprising:

the first mount comprising a primary first plate, the second mount is arranged a distance apart from the first mount in a primary direction, a second stiffening member that is configured to stiffen the adapter against bending about an axis that is parallel to the secondary direction, and a grip surface configured to grip the object to be driven with the pile driver, wherein the first mount extends in a secondary direction that is perpendicular to the primary direction.

19. The arrangement of claim 18, wherein the first mount comprises a first primary aperture extending through a part of the adapter in a direction that forms a minimum angle of at most 15 degrees with the first direction and a first tertiary aperture extending through a part of the adapter in a direction that forms a minimum angle of at least 75 degrees with the first direction and forms a minimum angle of at least 75 degrees with the first direction.

20. The arrangement of claim 18, wherein the second mount comprises a second primary aperture extending through a part of the adapter in a direction that in a direction that forms a minimum angle of at most 15 degrees with the primary direction and a second tertiary aperture extending through a part of the adapter in a direction that forms a minimum angle of at least 75 degrees with the primary direction and forms a minimum angle of at least 75 degrees with the secondary direction.

21. The arrangement of claim 20, wherein the primary first arm is pivotable about the primary axis independently of the primary second arm when the primary adapter is dismounted from the vibrator device.

22. The arrangement of claim 1, wherein the primary first arm is pivotable about the primary axis independently of the primary second arm when the primary adapter is dismounted from the vibrator device.

23. The arrangement of claim 1, wherein the first mount comprises a first primary plate and a bottom, wherein the bottom is provided with an aperture for fixing the primary adapter arrangement to the primary first attachment of the primary first arm.

24. The arrangement of claim 23, wherein the first primary plate comprises a first primary first aperture such that the first primary first aperture is configured to operate in connection with a primary first primary hole of the primary first attachment of the primary first arm, and the aperture of the bottom of the first mount is configured to operate in connection with a primary first secondary hole of the primary first attachment of the primary first arm.

25. The arrangement of claim 1, wherein a ratio of the second distance to the first distance is at most 1.0.

26. The arrangement of claim 1, wherein the first mount comprises a primary first plate extending in a direction that is away from the primary axis.

* * * * *